US009744415B2

(12) United States Patent
Frame et al.

(10) Patent No.: US 9,744,415 B2
(45) **Date of Patent: *Aug. 29, 2017**

(54) GOLF CLUB HAVING REMOVABLE WEIGHT

(71) Applicant: Acushnet Company, Fairhaven, MA (US)

(72) Inventors: Nick Frame, Vista, CA (US); Charles E. Golden, Encinitas, CA (US); Richard L. Cleghorn, Oceanside, CA (US); Scott A. Knutson, Escondido, CA (US); Steven J. Forshner, Vista, CA (US)

(73) Assignee: Acushnet Company, Fairhaven, MA (US)

( * ) Notice: Subject to any disclaimer, the term of this patent is extended or adjusted under 35 U.S.C. 154(b) by 30 days.

This patent is subject to a terminal disclaimer.

(21) Appl. No.: 14/979,151

(22) Filed: Dec. 22, 2015

(65) Prior Publication Data

US 2017/0173419 A1 Jun. 22, 2017

(51) Int. Cl.
*A63B 53/06* (2015.01)
*A63B 53/04* (2015.01)

(52) U.S. Cl.
CPC ..... *A63B 53/06* (2013.01); *A63B 53/0466* (2013.01); *A63B 2053/0433* (2013.01); *A63B 2053/0491* (2013.01)

(58) Field of Classification Search
CPC ..... A63B 2053/0491; A63B 53/06; A63B 53/0466; A63B 2053/0433
USPC ..... 473/334–339, 341, 345
See application file for complete search history.

(56) References Cited

U.S. PATENT DOCUMENTS

| | | | |
|---|---|---|---|
| 80,435 | A | 7/1868 | Way |
| 996,937 | A | 7/1911 | Mulock |
| 1,133,129 | A | 3/1915 | Govan |
| 1,167,106 | A | 1/1916 | Palmer |

(Continued)

FOREIGN PATENT DOCUMENTS

| | | |
|---|---|---|
| GB | 2133295 | 7/1984 |
| JP | 10137374 | 5/1998 |

(Continued)

OTHER PUBLICATIONS

U.S. Appl. No. 14/788,243, filed Jun. 30, 2015, Cleghorn et al.

(Continued)

*Primary Examiner* — Benjamin Layno
(74) *Attorney, Agent, or Firm* — Kevin N. McCoy

(57) ABSTRACT

A golf club head, including a hosel, a striking face, a sole extending aftward from a lower edge of the ball striking face, a crown extending aftward from an upper edge of the ball striking face, a skirt extending between the sole and the crown, a plurality of weight mounts disposed on at least one of the sole, the crown, and the skirt, and a weight retainer configured to engage the weight mounts, wherein each of the plurality of weight mounts comprise a locking feature, wherein the weight retainer comprises an engagement feature configured to engage the locking feature, wherein the engagement feature and the locking feature are configured to releasably lock the weight retainer to the golf club head in less than one full rotation of the weight retainer relative to the golf club head around an axis of rotation.

18 Claims, 17 Drawing Sheets

(56) References Cited

U.S. PATENT DOCUMENTS

| | | | | |
|---|---|---|---|---|
| 1,322,182 | A | 11/1919 | Duncan | |
| 1,534,600 | A | 4/1925 | Mattern | |
| 2,214,356 | A | 9/1940 | Wettlaufer | |
| 2,517,245 | A | 8/1950 | Scott | |
| 2,545,045 | A | 3/1951 | Rosan | |
| 3,064,980 | A | 11/1962 | Steiner | |
| 3,212,783 | A | 10/1965 | Bradley et al. | |
| 3,220,733 | A | 11/1965 | Saleeby | |
| 3,259,404 | A | 7/1966 | Papenguth | |
| 3,466,047 | A | 9/1969 | Rodia et al. | |
| 3,556,533 | A | 1/1971 | Hollis | |
| 3,604,755 | A | 9/1971 | Krekeler | |
| 3,652,094 | A * | 3/1972 | Glover | A63B 53/08 473/337 |
| 3,692,306 | A | 9/1972 | Glover | |
| 4,026,183 | A | 5/1977 | Bart | |
| 4,043,563 | A | 8/1977 | Churchward | |
| 4,052,075 | A | 10/1977 | Daly | |
| 4,085,934 | A | 4/1978 | Churchward | |
| 4,194,547 | A | 3/1980 | Sidor et al. | |
| 4,340,230 | A | 7/1982 | Churchward | |
| 4,423,874 | A | 1/1984 | Stuff, Jr. | |
| 4,443,145 | A | 4/1984 | Peschges | |
| 4,450,904 | A | 5/1984 | Volz | |
| 4,538,790 | A | 9/1985 | Williams et al. | |
| 4,602,787 | A | 7/1986 | Sugioka et al. | |
| 4,795,159 | A | 1/1989 | Nagamoto | |
| 4,867,458 | A | 9/1989 | Sumikawa et al. | |
| 4,869,507 | A | 9/1989 | Sahm | |
| 4,958,970 | A | 9/1990 | Rose et al. | |
| 5,050,879 | A | 9/1991 | Sun et al. | |
| 5,154,424 | A | 10/1992 | Lo | |
| 5,168,767 | A | 12/1992 | Morita | |
| 5,230,509 | A | 7/1993 | Chavez | |
| 5,236,164 | A | 8/1993 | Lorizzo | |
| 5,297,794 | A | 3/1994 | Lu | |
| 5,316,305 | A | 5/1994 | McCabe | |
| 5,320,005 | A | 6/1994 | Hsiao | |
| 5,518,243 | A | 5/1996 | Redman | |
| 5,547,326 | A | 8/1996 | Overhues | |
| 5,571,053 | A | 11/1996 | Lane | |
| 5,720,674 | A | 2/1998 | Galy | |
| 5,795,245 | A | 8/1998 | Chang et al. | |
| 5,860,779 | A | 1/1999 | Toosky et al. | |
| 5,904,460 | A | 5/1999 | Kawabata | |
| 5,916,042 | A | 6/1999 | Reimers | |
| 5,935,019 | A | 8/1999 | Yamamoto | |
| 5,947,840 | A | 9/1999 | Ryan | |
| 5,967,905 | A | 10/1999 | Nakahara et al. | |
| 6,017,177 | A | 1/2000 | Lanham | |
| 6,056,649 | A | 5/2000 | Imai | |
| 6,089,994 | A | 7/2000 | Sun | |
| 6,123,627 | A | 9/2000 | Antonious | |
| 6,162,132 | A | 12/2000 | Yoneyama | |
| 6,217,461 | B1 | 4/2001 | Galy | |
| 6,296,574 | B1 | 10/2001 | Kaldis | |
| 6,306,048 | B1 | 10/2001 | McCabe et al. | |
| 6,348,014 | B1 | 2/2002 | Chiu | |
| 6,379,265 | B1 | 4/2002 | Hirakawa et al. | |
| 6,409,612 | B1 | 6/2002 | Evans et al. | |
| 6,436,142 | B1 | 8/2002 | Paes et al. | |
| 6,458,044 | B1 | 10/2002 | Vincent et al. | |
| 6,648,772 | B2 | 11/2003 | Vincent et al. | |
| 6,719,510 | B2 | 4/2004 | Cobzaru | |
| 6,773,360 | B2 | 8/2004 | Willett et al. | |
| 6,811,496 | B2 | 11/2004 | Wahl et al. | |
| 6,860,818 | B2 | 3/2005 | Mahaffey et al. | |
| 6,881,158 | B2 | 4/2005 | Yang et al. | |
| 6,988,960 | B2 | 1/2006 | Mahaffey et al. | |
| 7,121,956 | B2 | 10/2006 | Lo | |
| 7,153,220 | B2 | 12/2006 | Lo | |
| 7,166,040 | B2 | 1/2007 | Hoffman et al. | |
| 7,166,041 | B2 | 1/2007 | Evans | |
| 7,179,034 | B2 | 2/2007 | Ladouceur | |
| 7,186,190 | B1 | 3/2007 | Beach et al. | |
| 7,189,169 | B2 | 3/2007 | Billings | |
| 7,223,180 | B2 | 5/2007 | Willett et al. | |
| 7,294,065 | B2 | 11/2007 | Liang et al. | |
| 7,326,472 | B2 | 2/2008 | Shimazaki et al. | |
| 7,351,161 | B2 | 4/2008 | Beach | |
| 7,407,447 | B2 | 8/2008 | Beach | |
| 7,410,425 | B2 | 8/2008 | Willett et al. | |
| 7,410,426 | B2 | 8/2008 | Willett et al. | |
| 7,419,441 | B2 | 9/2008 | Hoffman et al. | |
| 7,448,963 | B2 | 11/2008 | Beach et al. | |
| 7,452,285 | B2 | 11/2008 | Chao et al. | |
| 7,530,901 | B2 | 5/2009 | Imamoto | |
| 7,530,904 | B2 | 5/2009 | Beach et al. | |
| 7,540,811 | B2 | 6/2009 | Beach et al. | |
| 7,568,985 | B2 | 8/2009 | Beach et al. | |
| 7,578,753 | B2 | 8/2009 | Beach et al. | |
| 7,604,548 | B2 | 10/2009 | Cole | |
| 7,628,711 | B2 * | 12/2009 | Akinori | A63B 53/0466 411/337 |
| 7,632,194 | B2 | 12/2009 | Beach et al. | |
| 7,670,235 | B2 | 3/2010 | Lo | |
| 7,713,142 | B2 | 5/2010 | Hoffman et al. | |
| 7,717,804 | B2 | 5/2010 | Beach et al. | |
| 7,717,805 | B2 | 5/2010 | Beach et al. | |
| 7,758,452 | B2 | 7/2010 | Soracco | |
| 7,771,290 | B2 | 8/2010 | Bezilla et al. | |
| 7,775,905 | B2 | 8/2010 | Beach et al. | |
| 7,806,781 | B2 | 10/2010 | Imamoto | |
| 7,878,924 | B2 * | 2/2011 | Clausen | A63B 53/02 473/335 |
| 8,043,167 | B2 | 10/2011 | Boyd et al. | |
| 8,092,316 | B2 | 1/2012 | Breier et al. | |
| 8,105,175 | B2 | 1/2012 | Breier et al. | |
| 8,182,363 | B2 | 5/2012 | Bezilla et al. | |
| 8,192,302 | B2 | 6/2012 | Knutson et al. | |
| 8,292,757 | B2 | 10/2012 | Soracco | |
| 8,388,465 | B2 | 3/2013 | De La Cruz et al. | |
| 8,435,135 | B2 | 5/2013 | Stites et al. | |
| 8,540,589 | B2 | 9/2013 | Bezilla et al. | |
| 8,684,863 | B2 | 4/2014 | Bezilla et al. | |
| 9,095,753 | B2 * | 8/2015 | Bezilla | A63B 53/06 |
| 9,205,312 | B2 * | 12/2015 | Zimmerman | A63B 53/06 |
| 9,216,333 | B2 * | 12/2015 | Bezilla | A63B 53/06 |
| 9,504,884 | B2 * | 11/2016 | Bennett | A63B 53/0466 |
| 2003/0148818 | A1 | 8/2003 | Myrhum et al. | |
| 2006/0058112 | A1 | 3/2006 | Haralason et al. | |
| 2006/0100029 | A1 | 5/2006 | Lo | |
| 2006/0122004 | A1 | 6/2006 | Chen et al. | |
| 2006/0217216 | A1 | 9/2006 | Iizuka | |
| 2007/0155534 | A1 | 7/2007 | Tsai et al. | |
| 2008/0039229 | A1 | 2/2008 | Lo | |
| 2008/0132353 | A1 * | 6/2008 | Hsiao | A63B 53/0466 473/336 |
| 2014/0113741 | A1 | 4/2014 | Bezilla | |

FOREIGN PATENT DOCUMENTS

| | | |
|---|---|---|
| JP | 10234902 | 9/1998 |
| JP | 10248964 | 9/1998 |
| JP | 11319167 | 11/1999 |
| JP | 2000005350 | 1/2000 |
| JP | 2000176059 | 6/2000 |
| JP | 2001000606 | 1/2001 |
| JP | 2001149514 | 6/2001 |
| JP | 2002011124 | 1/2002 |
| JP | 2005160947 | 6/2005 |
| JP | 2006000435 | 1/2006 |
| JP | 2006081862 | 3/2006 |
| JP | 2006122334 | 5/2006 |
| JP | 2006187489 | 7/2006 |
| JP | 2006198251 | 8/2006 |
| JP | 2006239154 | 9/2006 |
| JP | 2007313304 | 12/2007 |

OTHER PUBLICATIONS

U.S. Appl. No. 14/977,116, filed Dec. 21, 2015, Luttrell et al.
U.S. Appl. No. 14/581,917, filed Dec. 23, 2014, Bennett.

(56) References Cited

OTHER PUBLICATIONS

U.S. Appl. No. 14/932,061, filed Nov. 4, 2015, Zimmerman et al.

* cited by examiner

GOLF CLUB HAVING REMOVABLE WEIGHT

TECHNICAL FIELD

This present technology generally relates to systems, devices, and methods related to golf clubs, and more specifically to golf club heads having a removable weight.

DESCRIPTION OF THE RELATED TECHNOLOGY

The trend of lengthening golf courses to increase their difficulty has resulted in a high percentage of amateur golfers constantly searching for ways to achieve more distance from their golf shots. The golf industry has responded by providing golf clubs specifically designed with distance and accuracy in mind. The size of wood-type golf club heads has generally been increased while multi-material construction and reduced wall thicknesses have been included to provide more mass available for selective placement through the head. The discretionary mass placement has allowed the club to possess a higher moment of inertia (MOI), which translates to a greater ability to resist twisting during off-center ball impacts and less of a distance penalty for those off-center ball impacts. Additionally, discretionary mass placement has allowed the club to more optimally locate the center of gravity (CG) of the golf club head, and sometimes make that CG location adjustable through the use of adjustable and/or moveable weights.

Various methods are used to selectively locate mass throughout golf club heads, including thickening portions of the body casting itself or strategically adding separate weight elements during the manufacture of the club head. An example, shown in U.S. Pat. No. 7,186,190, discloses a golf club head comprising a number of moveable weights attached to the body of the club head. The club head includes a number of threaded ports into which the moveable weights are screwed. Though the mass characteristics of the golf club may be manipulated by rearranging the moveable weights, the cylindrical shape of the weights and the receiving features within the golf club body necessarily moves a significant portion of the mass toward the center of the club head, which may not maximize the peripheral weight of the club head or the MOI.

Alternative approaches for selectively locating mass in a club head utilize composite multi-material structures. These composite structures utilize two, three, or more materials that have different physical properties including different densities. An example of this type of composite club head is shown in U.S. Pat. No. 5,720,674. The club head comprises an arcuate portion of high-density material bonded to a recess in the back-skirt. Because composite materials like those found in the club head must be bonded together, for example by welding, swaging, or using bonding agents such as epoxy, they may be subject to delamination or corrosion over time. This component delamination or corrosion results in decreased performance in the golf club head and can lead to club head failure.

Though many methods of optimizing the mass properties of golf club heads exist, there remains a need in the art for a golf club head comprising at least one easily and quickly removable weight having a secure attachment.

SUMMARY

The systems, methods, and devices described herein have innovative aspects, no single one of which is indispensable or solely responsible for their desirable attributes. Without limiting the scope of the claims, some of the advantageous features will now be summarized.

The present technology is directed to a golf club head having at least one removable weight member. The removable weight member is preferably securely mounted to the golf club head with less than a full rotation of weight retainer relative to the golf club head.

One non-limiting embodiment of the present technology includes a golf club head, comprising a hosel; a striking face; a sole extending aftward from a lower edge of said ball striking face; a crown extending aftward from an upper edge of said ball striking face; a skirt extending between said sole and said crown; a plurality of weight mounts disposed on at least one of said sole, said crown, and said skirt; and a weight retainer configured to engage said weight mounts; wherein each of said plurality of weight mounts comprise a locking feature; wherein said weight retainer comprises an engagement feature configured to engage the locking feature; wherein said engagement feature and said locking feature are configured to releasably lock said weight retainer to said golf club head in less than one full rotation of said weight retainer relative to said golf club head around an axis of rotation; wherein said engagement feature comprises a transition portion and a detent; wherein said locking feature comprises a protrusion and a deflectable arm; wherein said protrusion is configured to reside in said detent when said weight retainer is locked to said golf club head.

In an additional non-limiting embodiment of the present technology said engagement feature comprises a ramp.

In an additional non-limiting embodiment of the present technology said deflectable arm is configured to deflect as said protrusion rides up said transition portion of said engagement feature, and wherein said deflectable arm forces said protrusion into said detent.

In an additional non-limiting embodiment of the present technology said weight mount is substantially flush with an external surface of said golf club head.

In an additional non-limiting embodiment of the present technology said weight mount, including said locking feature, is substantially uniform in thickness.

In an additional non-limiting embodiment of the present technology said weight retainer is permanently affixed to a weight member.

In an additional non-limiting embodiment of the present technology said locking feature is configured to allow said protrusion to move in a direction substantially parallel to said axis of rotation as said deflectable arm deflects.

An additional non-limiting embodiment of the present technology includes a golf club head, comprising a hosel; a striking face; a sole extending aftward from a lower edge of said ball striking face; a crown extending aftward from an upper edge of said ball striking face; a skirt extending between said sole and said crown; a plurality of weight mounts disposed on at least one of said sole, said crown, and said skirt; and a weight retainer configured to engage said weight mounts; wherein each of said plurality of weight mounts comprise a locking feature; wherein said weight retainer comprises an engagement feature configured to engage the locking feature; wherein said engagement feature and said locking feature are configured to releasably lock said weight retainer to said golf club head in less than one full rotation of said weight retainer relative to said golf club head around an axis of rotation; wherein said engagement feature comprises a protrusion; wherein said locking feature comprises a transition portion and a detent; wherein said protrusion is configured to reside in said detent when said weight retainer is locked to said golf club head.

In an additional non-limiting embodiment of the present technology said engagement feature comprises a slot.

In an additional non-limiting embodiment of the present technology said slot is formed in an inner wall of said weight mount.

In an additional non-limiting embodiment of the present technology said engagement feature further comprises a deflectable arm, wherein said deflectable arm is configured to deflect as said protrusion slide along said transition portion of said locking feature, and wherein said deflectable arm forces said protrusion into said detent.

In an additional non-limiting embodiment of the present technology wherein said engagement feature is configured to allow said protrusion to move in a direction substantially perpendicular to said axis of rotation as said deflectable arm deflects.

An additional non-limiting embodiment of the present technology includes a spring located between said weight mount and said weight retainer.

In an additional non-limiting embodiment of the present technology said weight retainer comprises a cavity configured to house a weight member.

An additional non-limiting embodiment of the present technology includes a golf club head, comprising a hosel; a striking face; a sole extending aftward from a lower edge of said ball striking face; a crown extending aftward from an upper edge of said ball striking face; a skirt extending between said sole and said crown; a plurality of weight mounts disposed on at least one of said sole, said crown, and said skirt; and a weight retainer configured to engage said weight mounts; wherein each of said plurality of weight mounts comprise a locking feature; wherein said weight retainer comprises an engagement feature configured to engage the locking feature; wherein said engagement feature and said locking feature are configured to releasably lock said weight retainer to said golf club head in less than one full rotation of said weight retainer relative to said golf club head around an axis of rotation; wherein said engagement feature comprises a detent; wherein said locking feature comprises a protrusion and a transition portion; wherein said protrusion is configured to reside in said detent when said weight retainer is locked to said golf club head.

In an additional non-limiting embodiment of the present technology said weight mount comprises a ceiling, wherein said ceiling is substantially flush with an external surface of said golf club head, and wherein said ceiling comprises an aperture configured to receive said weigh retainer in an unlocked position.

In an additional non-limiting embodiment of the present technology said wherein said ceiling further comprises an aperture configured to receive said weight retainer in an unlocked position.

An additional non-limiting embodiment of the present technology includes a spring, said spring configured to force said weight retainer towards said ceiling of said weight mount.

In an additional non-limiting embodiment of the present technology said spring is dome shaped.

In an additional non-limiting embodiment of the present technology said weight retainer is formed integrally with said weight member.

BRIEF DESCRIPTION OF THE DRAWINGS

The accompanying drawings form a part of the specification and are to be read in conjunction therewith. The illustrated embodiments, however, are merely examples and are not intended to be limiting. Like reference numbers and designations in the various drawings indicate like elements.

DETAILED DESCRIPTION

Figure 1:
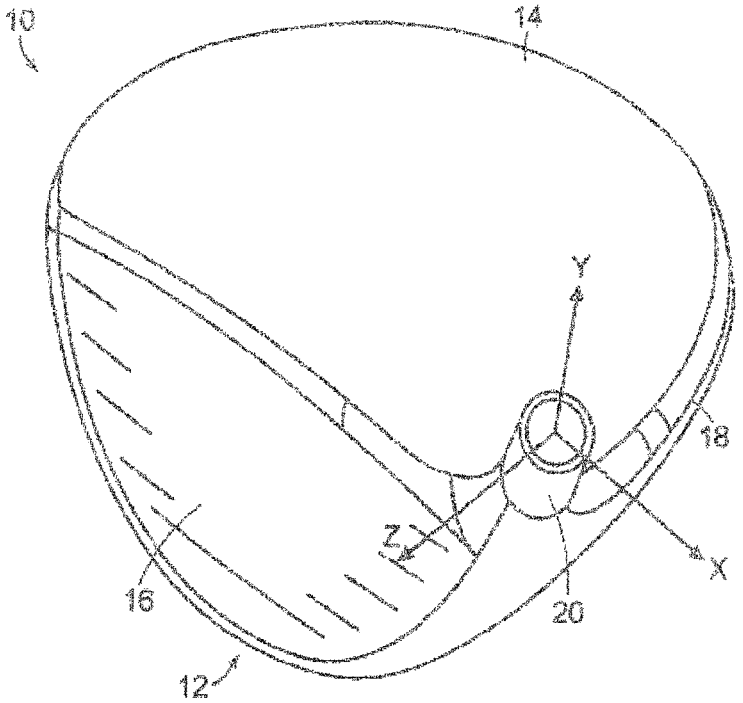
FIG. 1 illustrates a perspective view of a golf club head.

In the following detailed description, reference is made to the accompanying drawings, which form a part of the present disclosure. The illustrative embodiments described in the detailed description, drawings, and claims are not meant to be limiting. Other embodiments may be utilized, and other changes may be made, without departing from the spirit or scope of the subject matter presented herein. It will be readily understood that the aspects of the present disclosure, as generally described herein, and illustrated in the Figures, can be arranged, substituted, combined, and designed in a wide variety of different configurations, all of which are explicitly contemplated and form part of this disclosure. For example, a system or device may be implemented or a method may be practiced using any number of the aspects set forth herein. In addition, such a system or device may be implemented or such a method may be practiced using other structure, functionality, or structure and functionality in addition to or other than one or more of the aspects set forth herein. Alterations and further and further modifications of inventive features illustrated herein, and additional applications of the principles of the inventions as illustrated herein, which would occur to one skilled in the relevant art and having possession of this disclosure, are to be considered within the scope of the invention.

Other than in the operating examples, or unless otherwise expressly specified, all of the numerical ranges, amounts, values and percentages such as those for amounts of materials, moments of inertias, center of gravity locations, loft and draft angles, and others in the following portion of the specification may be read as if prefaced by the word "about" even though the term "about" may not expressly appear with the value, amount, or range. Accordingly, unless indicated to the contrary, the numerical parameters set forth in the following specification and attached claims are approximations that may vary depending upon the desired properties sought to be obtained by the present invention. At the very least, and not as an attempt to limit the application of the doctrine of equivalents to the scope of the claims, each numerical parameter should at least be construed in light of the number of reported significant digits and by applying ordinary rounding techniques.

Notwithstanding that the numerical ranges and parameters setting forth the broad scope of the invention are approximations, the numerical values set forth in the specific examples are reported as precisely as possible. Any numerical value, however, inherently contains certain errors necessarily resulting from the standard deviation found in their respective testing measurements. Furthermore, when numerical ranges of varying scope are set forth herein, it is contemplated that any combination of these values inclusive of the recited values may be used.

In describing the present technology, the following terminology may have been used: The singular forms "a," "an," and "the" include plural referents unless the context clearly dictates otherwise. Thus, for example, reference to an item includes reference to one or more items. The term "plurality" refers to two or more of an item. The term "substantially" means that the recited characteristic, parameter, or value need not be achieved exactly, but that deviations or variations, including for example, tolerances, measurement error, measurement accuracy limitations and other factors known to those of skill in the art, may occur in amounts that do not preclude the effect the characteristic was intended to provide. A plurality of items may be presented in a common list for convenience. However, these lists should be construed as though each member of the list is individually identified as a separate and unique member. Thus, no individual member of such list should be construed as a de facto equivalent of any other member of the same lists solely based on their presentation in a common group without indications to the contrary. Furthermore, where the terms "and" and "or" are used in conjunction with a list of items, they are to be interpreted broadly, in that any one or more of the listed items may be used alone or in combination with other listed items. The term "alternatively" refers to a selection of one of two or more alternatives, and is not intended to limit the selection of only those listed alternative or to only one of the listed alternatives at a time, unless the context clearly indicated otherwise.

Features of the present disclosure will become more fully apparent from the following description and appended claims, taken in conjunction with the accompanying drawings. After considering this discussion, and particularly after reading the section entitled "Detailed Description" one will understand how the illustrated features serve to explain certain principles of the present disclosure.

The golf club head of the present invention is preferably hollow, such as a metal wood type golf club head, but may include any club head type, such as iron-type club heads. The golf club head generally includes a hosel, a striking face, a crown, a sole, and a skirt that combine to define a hollow interior cavity.

Figure 2:
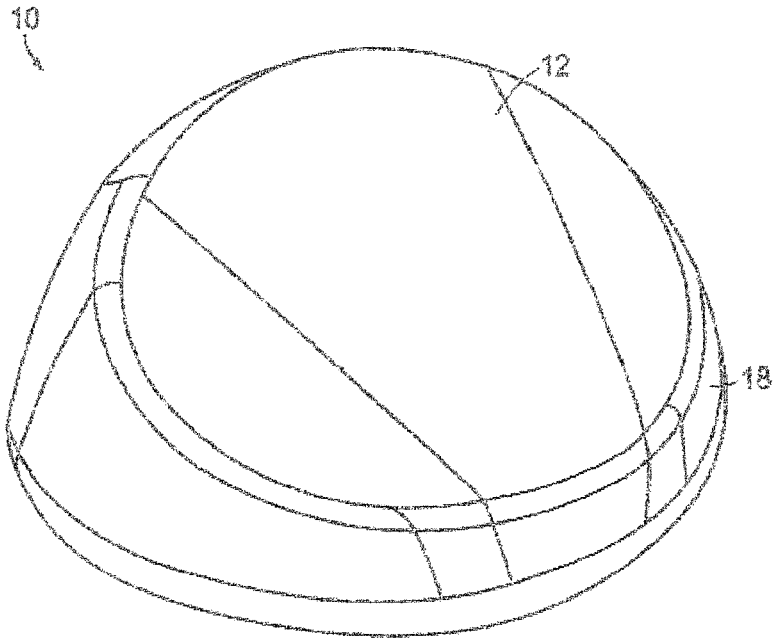
FIG. 2 illustrates a perspective view of the bottom of the golf club head of FIG. 1.
Figure 3:
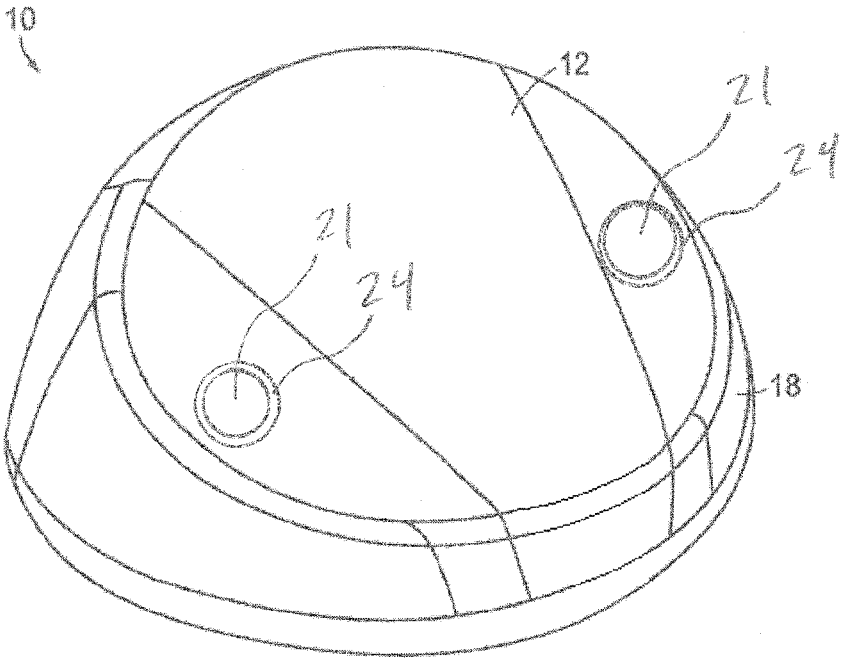
FIG. 3 illustrates a perspective view of the bottom of the golf club head including a plurality of weight members received in weight mounts.
Figure 4:
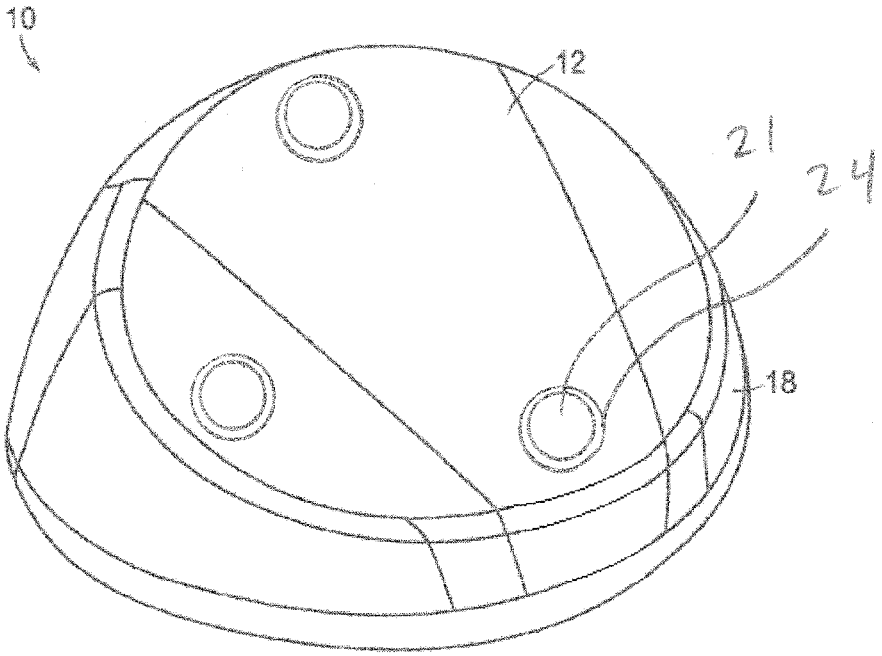
FIG. 4 illustrates a perspective view of the bottom of an additional embodiment of the golf club head including a plurality of weight members received in weight mounts.

The inventive golf club head also has a low profiled weight member disposed on a portion of the club head, and preferably on the crown, sole and/or skirt of the golf club head. The embodiments described below are generally illustrated so that the weight member is attached at least partially to the sole for convenience. FIG. 1 illustrates a perspective view of a golf club head 10. FIG. 2 illustrates a perspective view of the bottom of the golf club head 10 of FIG. 1. Club head 10 includes a sole 12, a crown 14, a striking face 16, a skirt 18, and a hosel 20. Sole 12 generally provides the lower surface of golf club head 10 when the club head is placed in an address position. FIG. 3 illustrates a perspective view of the bottom of the golf club head 10 including a plurality of weight members 21 received in weight mounts 24. FIG. 4 illustrates a perspective view of the bottom of an additional embodiment of the golf club head 10 including a plurality of weight members 21 received in weight mounts 24.

The embodiments described herein are generally illustrated so that the weight members are attached at least partially to the sole for convenience. However, as will be appreciated by a person having ordinary skill, weight mounts, weight members, and weight retainers having the same structures as those described may be located on any portion of the golf club head, such as the crown and/or skirt. Additionally, weight mounts are illustrated separate from the golf club head for convenience. However, as will be appreciated by a person having ordinary skill, weight mounts described herein are intended to be either permanently affixed to the golf club head or formed integrally with the golf club head.

The inventive golf club head 10 includes removable weight members 21 configured to alter the location of the center of gravity (C.G.) of the golf club head 10 when the weight members 21 are added, removed, and/or exchanged with weight members 21 of different weight. The weight members 21 are retained in weight mounts 24, configured to couple the weight members 21 to the golf club head 10. The golf club head 10 preferably includes a plurality of weight mounts 24. In some embodiments, the C.G. can be manipulated by exchanging one or more weight members 21 on the golf club head 10 with another weight member 21 on the golf club head 10. In other embodiments, a single weight member 21 may be transferred from one weight mount 24 to another weight mount 24. In additional embodiments, one or more weight members 21 may be exchanged with a different weight member 21 having a different mass.

It is generally preferable to have the capability of adjusting the C.G. quickly and easily. Several inventive embodiments of weight members and weight mounts are described herein which allow the user to remove and install weight members from weight mounts quickly and easily. Additionally, the weight mounts must retain the weight members to the golf club head when the golf club head strikes a golf ball, without causing any rattling, vibration, or loosening of the weight member relative to the golf club head. Traditionally, weight members are retained by a combination of male and female threads. The weight member is rotated relative to the weight mount a plurality of turns until the weight member bottoms out against a portion of the golf club head, and the threads begin to bind as the male threads are loaded against the female threads, locking the weight member in place. This however takes multiple rotations of the weight member relative to the golf club head. Additionally, threads add the possibility of cross threading, which can destroy the ability to either remove or install the weight member into the weight mount. The weight members, weight mounts, and weight retainers described herein, are configured to be locked to the golf club head with one rotation or less of the weight retainer, in other words, less than or equal to 360 degrees, relative to the weight mount of the golf club head, and more preferably, with 180 degrees or less, and most preferably with 90 degrees or less.

Several embodiments herein utilize either a spring force of some kind or a binding to lock the weight member relative to the weight mount. Some of the embodiments utilize a spring exerting a force which is substantially parallel to the axis of rotation of the weight member to lock the weight member in place. Other embodiments utilize a spring exerting a force which is substantially perpendicular to the axis of rotation of the weight retainer to lock the weight member in place.

Both weight members and weight retainers are discussed herein. In some embodiments, the weight members are generally utilized to change the overall weight of the golf club head, move the CG of the golf club head, or alter the MOI of the golf club head. The weight retainers are configured to lock the weight members into the weight mounts of the golf club head. In some embodiments, the weight retainer can be affixed to or formed integrally with the weight member. In other embodiments, the weight retainer may be separate from the weight member. The term weight retainer, when used herein, can be used to describe both weight retainers formed and operating separately from a weight member to retain the weight member, as well as weight members formed integrally with weight retainers, the latter being the default definition. The description and claims will refer to a weight member particularly if the particular embodiment being described includes a weight member as a separate piece from the weight retainer.

Figure 5:
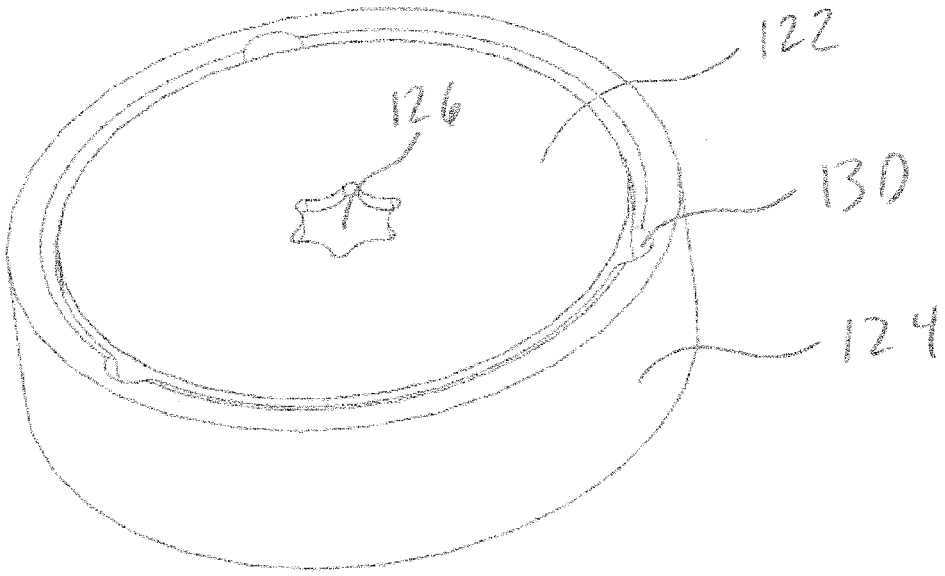
FIG. 5 illustrates a perspective view of one embodiment of a weight retainer locked in a weight mount.
Figure 6:
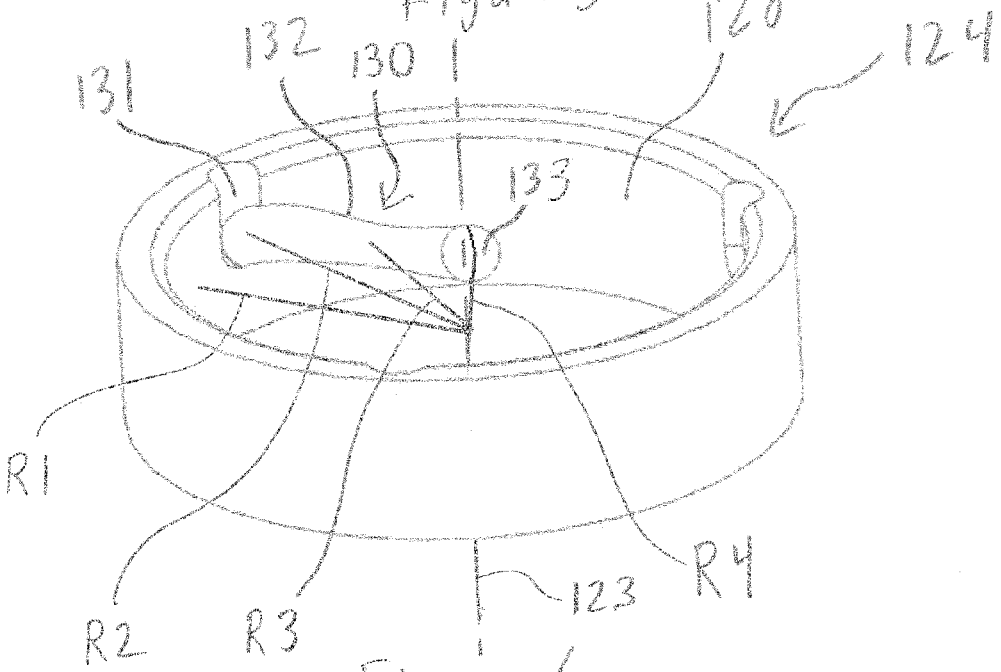
FIG. 6 illustrates a perspective view of the weight mount of FIG. 5.
Figure 7:
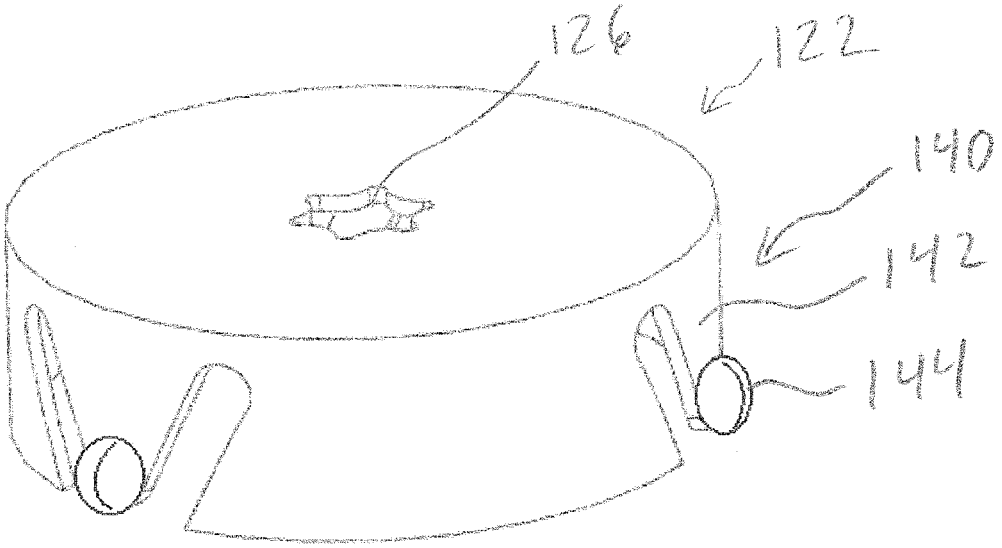
FIG. 7 illustrates a perspective view of the weight retainer of FIG. 5.
Figure 8:
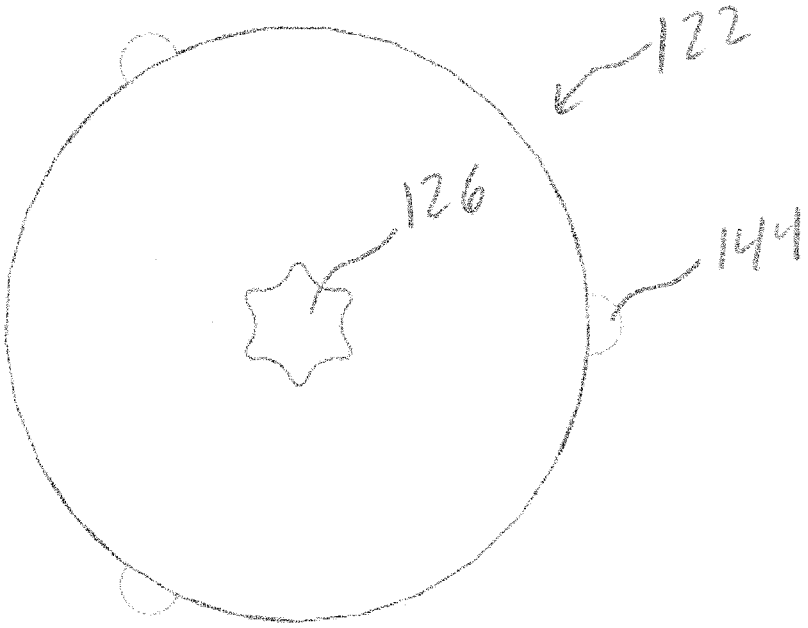
FIG. 8 illustrates a top view of the weight retainer of FIG. 5.

FIG. 5 illustrates a perspective view of one embodiment of a weight retainer 122 locked in a weight mount 124. FIG. 6 illustrates a perspective view of the weight mount 124 of FIG. 5. FIG. 7 illustrates a perspective view of the weight retainer 122 of FIG. 5. FIG. 8 illustrates a top view of the weight retainer 122 of FIG. 5. The weight retainer 122 includes a tool receiving feature 126. A user can install a tool into the tool receiving feature 126 and apply a torque to the weight retainer 122, rotating it relative to the weight mount 124 to either lock, or unlock the weight retainer 122 to the golf club head. The weight mount 124 includes a substantially cylindrical cavity configured to receive the weight retainer 122 and includes an inner wall 128. The weight mount 124 includes a locking feature 130 configured to lock the weight retainer 122 in place. As illustrated in FIG. 6, the locking feature can be a slot 130 configured to receive a portion of the weight retainer 122. The slot 130 is formed into the inner wall 128 of the weight mount 124. In some embodiments, the weight retainer 122 is integrally formed with a weight member 121. In some embodiments, the weight retainer 122 can include a cavity within to house a separate weight member 121.

The weight retainer 122 can include at least one engagement feature 140 configured to engage the locking feature 130 of the weight mount and lock the weight retainer 122 to the golf club head. As illustrated in FIGS. 7 and 8, the engagement feature 140 can include a deflectable arm 142 and a protrusion 144. The deflectable arm 142 is configured so that the protrusion 144 can deflect in a direction substantially perpendicular to the axis of rotation of the weight retainer 122. The protrusion 144 is configured to engage the locking feature 130 of the weight mount. The protrusion 144 can be substantially spherical in shape as illustrated in FIGS. 7 and 8.

The slot 130 can include an entry portion 131, a transition portion 132, and a detent 133. The slot 130 is configured to deflect the deflectable arm 142 of the weight retainer 122 as the weight retainer 122 is rotated relative to the weight mount 124. The entry portion 131 is configured to receive the engagement feature 140 of the weight retainer 122 as the weight retainer 122 is installed into the golf club head. The transition portion 132, is configured to deflect the deflectable arm 142 of the weight retainer 122 as the weight retainer 122 is rotated. The detent 133 is configured to receive the protrusion 144 of the engagement feature 140. As illustrated in FIG. 6, the inner wall 128 of the weight mount 124 has a radius R1 from the axis of rotation 123 of the weight retainer 122. Additionally, the entry portion 131 of the slot 130 has an effective radius R2. Effective radius is defined as the distance from the axis of rotation 123 to the portion of the slot which contacts and deflects the engagement feature 140 of the weight retainer. Radius R2 is greater than R1, which forces the engagement feature 140 of the weight retainer to follow the slot 130 once the weight retainer 122 is inserted into the weight mount 124. The transition portion 132 has an effective radius R3 that begins substantially similar to radius R2 and decreases in length as the transition portion 132 approaches the detent 133. Then the detent has an effective radius R4 which is greater than the Radius R3 adjacent the detent 133. The slot geometry described above causes the engagement feature 140 of the weight retainer 122 to deflect as the weight retainer 122 is rotated in a first direction (clockwise as illustrated in FIG. 6) and the protrusion 144 slides along the transition portion 132. Once the protrusion reaches the detent 133, the energy stored in the engagement feature 140 from being deflected forces the protrusion 144 into the detent 133, locking the weight retainer 122 to the weight mount 124 and the golf club head. In order to unlock the weight retainer 122 and remove it from the golf club head, the user must apply a torque to the weight retainer 122 in a second direction, (counter clockwise as illustrated in FIG. 6), opposite the first direction. The torque must be large enough to deflect the engagement feature 140 of the weight retainer 122 such that the protrusion 133 leaves the detent and slides through the transition portion 132 as the weight retainer 122 rotates relative to the weight mount 124. In addition to the varying effective radii R2, R3, and R4 of the slot 130, the slot can also drive the weight retainer 122 towards the golf club head as it is rotated in a first direction, as illustrated in FIG. 6, by angling at least a portion of the slot 130.

Figure 9:
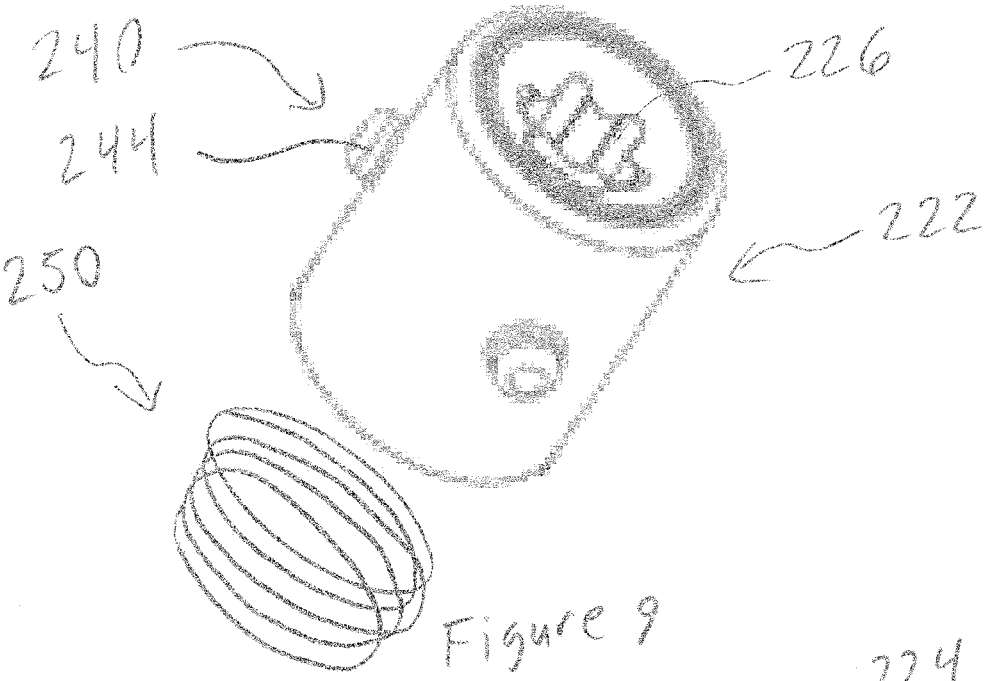
FIG. 9 illustrates a perspective view of one embodiment of a weight retainer and spring.
Figure 10:
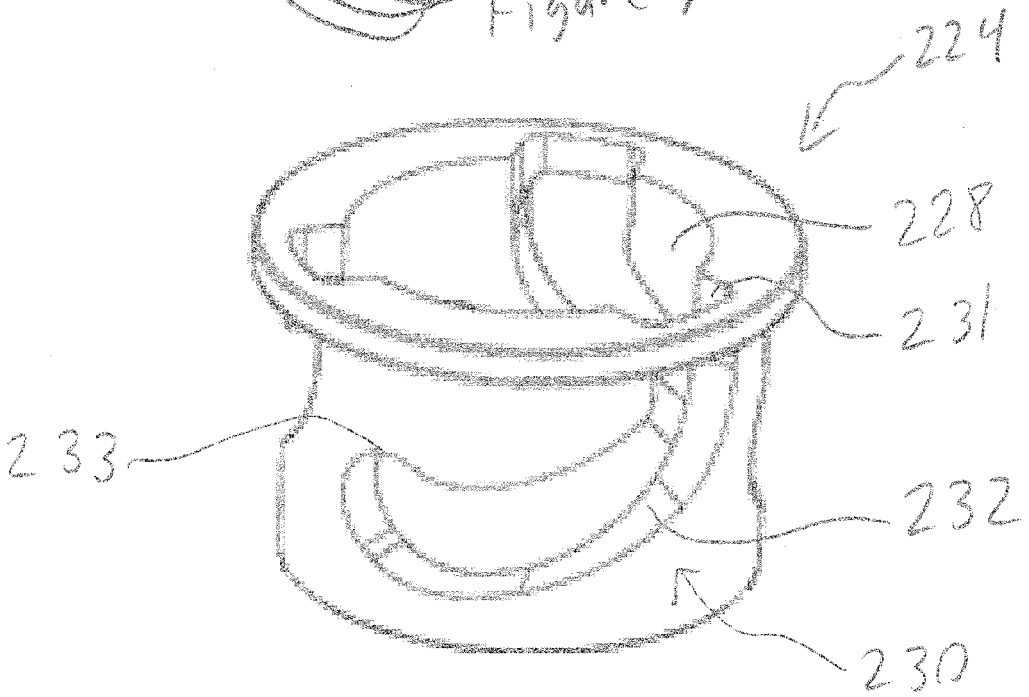
FIG. 10 illustrates a perspective view of one embodiment of a weight mount.

Rather than utilize a spring force that acts substantially perpendicular to the axis of rotation like the embodiment illustrated in FIGS. 5-8, many of the embodiments below generally utilize a spring force acting substantially parallel to the axis of rotation. FIG. 9 illustrates a perspective view of one embodiment of a weight retainer 222 and spring 250. FIG. 10 illustrates a perspective view of one embodiment of a weight mount 224. The weight retainer 222 includes at least one engagement feature 240 configured to engage the weight mount 224 and lock the weight retainer 222 to the golf club head. As illustrated in FIG. 9, the engagement feature can be a protrusion 244. The weight mount 224 includes a substantially cylindrical cavity configured to receive the weight retainer 222 and includes an inner wall 228. The weight mount 224 includes a locking feature 230 configured to lock the weight retainer 222 in place. As illustrated in FIG. 10, the locking feature 230 can be a slot 230 configured to receive a portion of the weight retainer 222. The slot 230 can include an entry portion 231, a transition portion 232, and a detent 233. The entry portion 231 is configured to receive the engagement feature 240 of the weight retainer 222 as the weight retainer 222 is installed into the golf club head. The transition portion 232, is configured to force the engagement feature 240 and the weight retainer 222 towards the golf club head as the weight retainer 222 is rotated. The spring 250 is configured to be located between the weight retainer 222 or weight member, if formed separately from the weight retainer 222, and the golf club head, forcing the weight retainer 222 away from the golf club head. The transition portion 232 of the slot is angled relative to the axis of rotation, such that the torque the user applies when rotating the weight retainer 222 in a first direction in combination with angle of the slot 230 causes the weight retainer to compress the spring 250. The detent 233 is configured to receive the protrusion 244 of the engagement feature 240 and lock the weight retainer 222 in place once the engagement feature 240 passes the end of the transition portion of 232 of the slot 230 and the spring 250 forces the engagement feature 240 into the detent 233.

Figure 11:
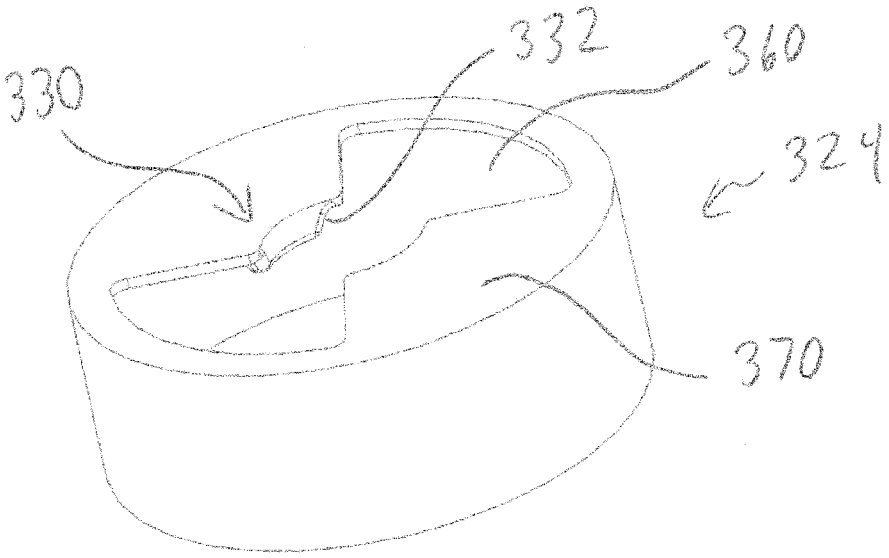
FIG. 11 illustrates a perspective view of an additional embodiment of a weight mount.
Figure 12:
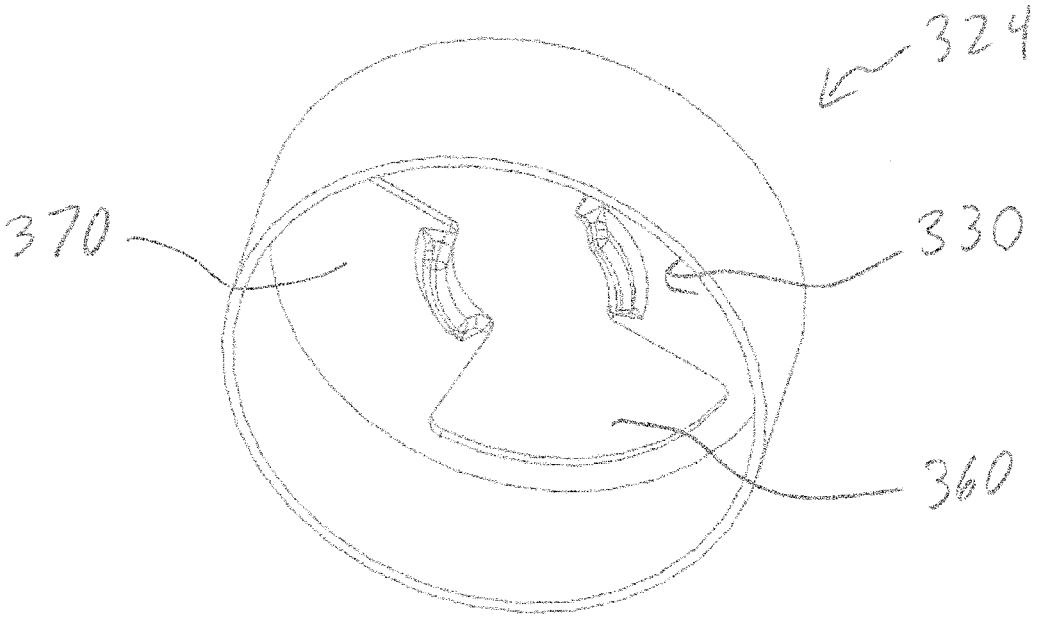
FIG. 12 illustrates an additional perspective view the weight mount of FIG. 11.
Figure 13:
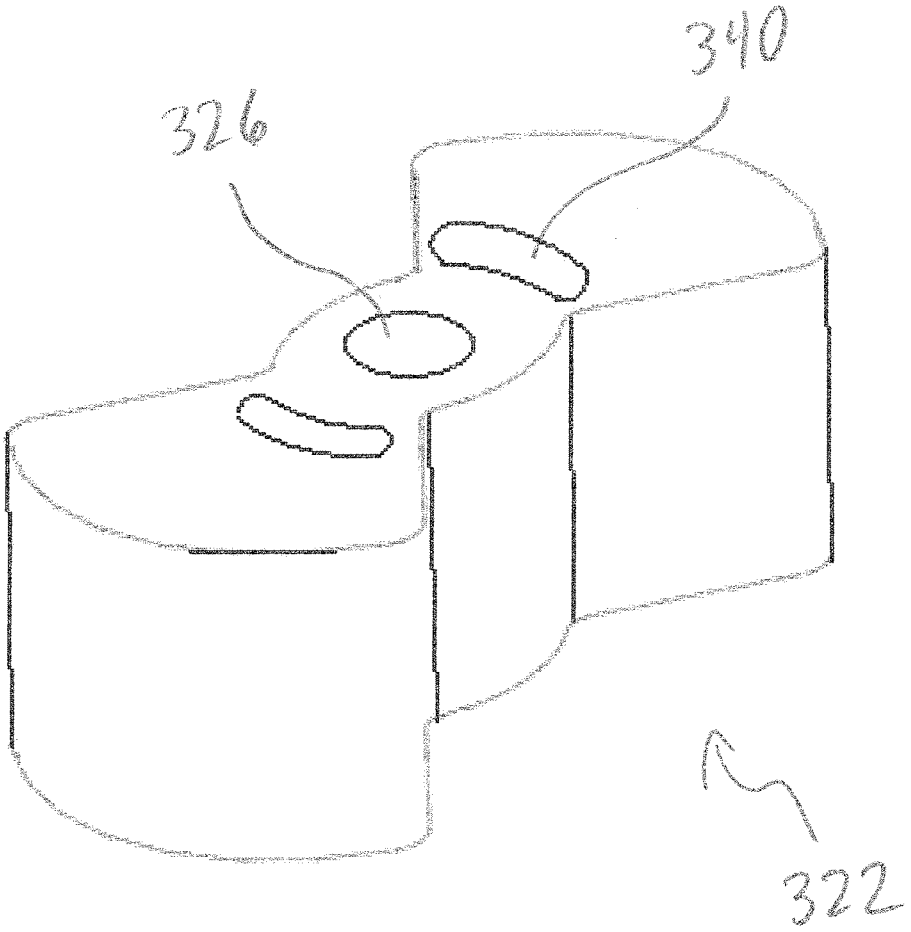
FIG. 13 illustrates a perspective view of an additional embodiment of a weight retainer.
Figure 14:
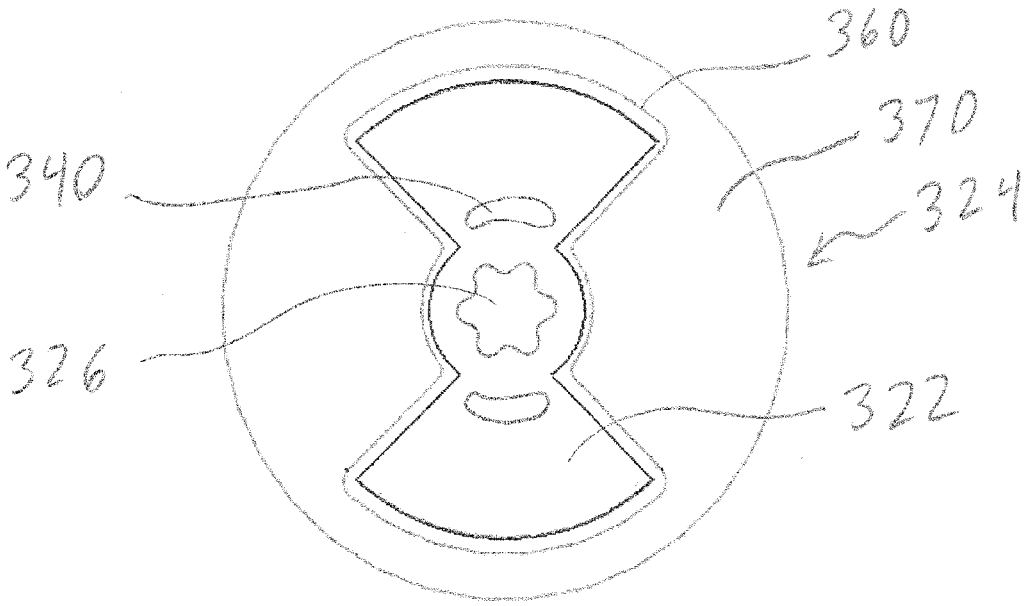
FIG. 14 illustrates a top view of the weight retainer of FIG. 13 in an unlocked position inside the weight mount of FIG. 11.
Figure 15:
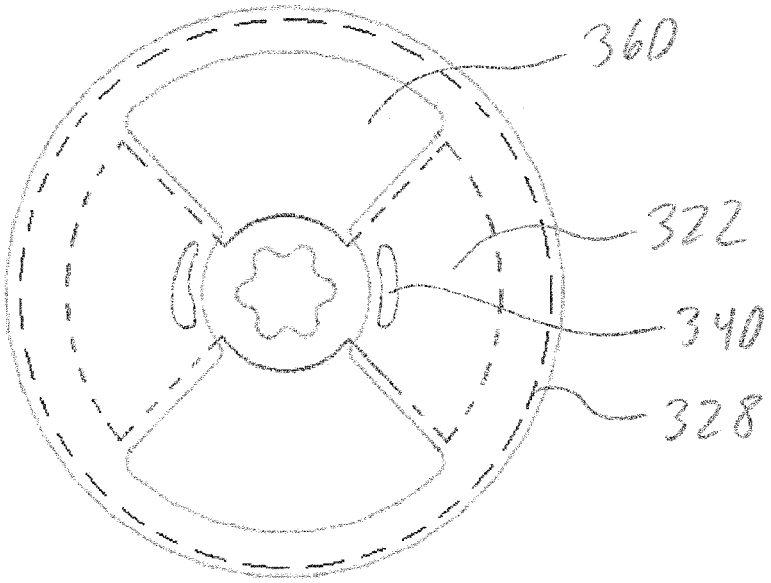
FIG. 15 illustrates a top view of the weight retainer of FIG. 13 in a locked position inside the weight mount of FIG. 11.
Figure 16:
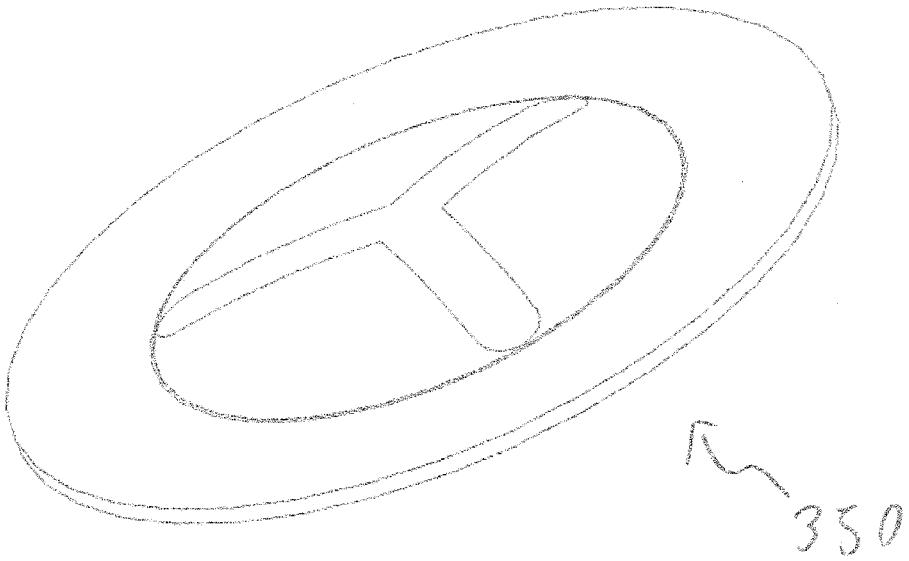
FIG. 16 illustrates a perspective view of one embodiment of a spring.
Figure 17:
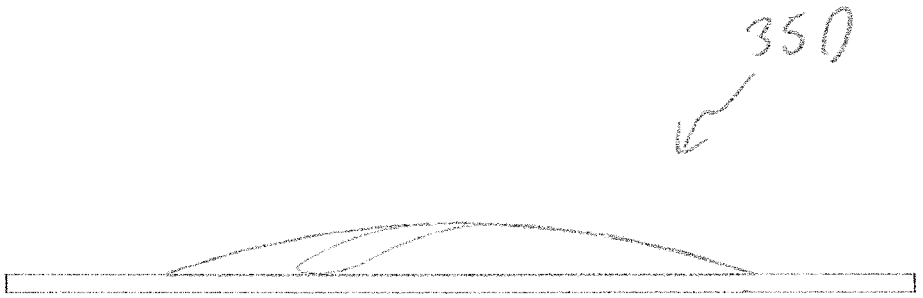
FIG. 17 illustrates a side view of the spring of FIG. 16.

FIG. 11 illustrates a perspective view of an additional embodiment of a weight mount 324. FIG. 12 illustrates an additional perspective view the weight mount 324 of FIG. 11. FIG. 13 illustrates a perspective view of an additional embodiment of a weight retainer 322. FIG. 14 illustrates a top view of the weight retainer 322 of FIG. 13 in an unlocked position inside the weight mount 324 of FIG. 11. FIG. 15 illustrates a top view of the weight retainer 322 of FIG. 13 in a locked position inside the weight mount 324 of FIG. 11. FIG. 16 illustrates a perspective view of one embodiment of a spring 350. FIG. 17 illustrates a side view of the spring 350 of FIG. 16.

The weight mount 324 includes a ceiling 370 with an aperture 360 formed through it. The aperture 360 is configured to receive the weight retainer 322. The weight mount 324 includes at least one locking feature 330. The locking feature 330 can be a protrusion extending from the inside of the ceiling 370 as illustrated in FIGS. 11 and 12. The protrusion 330 can include a transition portion 332 at the end angled relative to the axis of rotation of the weight retainer 322. The weight retainer 322 can include at least one engagement feature 340 configured to engage the locking feature 330 of the weight mount 324. The engagement feature 340 can be a detent 340 as illustrated in FIG. 13. The detent 340 can also be tapered to complement the transition portion 332 of the protrusion 330. Additionally, the protrusion 330 and detent 340 can be configured for a wedge fit to minimize rattling and vibration. A spring 350, such as the one illustrated in FIGS. 16 and 17, can be located inside the weight mount 324, and configured to force the weight retainer 322 away from the club head. The weight mount 324 is illustrated without a floor for convenience, but the spring would preferably be located against the floor of the weight mount 324, which would be opposite the ceiling 370. In some embodiments, the ceiling 370 can be flush with an external surface of the golf club head such as the sole. In other embodiments, the ceiling 370 may be raised away from the external surface of the golf club head. In yet another embodiment, the ceiling 370 may be recessed into the golf club head relative to the external surface.

The weight retainer 322 could be inserted into the weight mount 324 through the aperture 360 in an unlocked position as illustrated in FIG. 14. Then the weight retainer 322 can be rotated relative to the weight mount 324. As the weight retainer 322 contacts the transition portion 332 of the protrusion 330, the protrusion 330 forces the weight retainer 322 towards the golf club head, against the spring 350, until the weight retainer 322 reaches a locked position, as illustrated in FIG. 15, where the protrusion 330 can engage the engagement feature 340 of the weight retainer 320, allowing the weight retainer 322 to move away from the golf club head as the protrusion 330 enters the detent 340, and the spring forces the weight retainer 322 into the ceiling 370, locking the weight retainer 322 in place.

The spring 350 illustrated in FIGS. 16 and 17 is different than a conventional compression spring, such as the one illustrated in FIG. 9. The spring 350 is at least partially dome shaped and may include channels formed therein as illustrated in FIGS. 16 and 17. The dome portion can deform as force is applied by the weight retainer 322, the spring 350 applying a force against the weight retainer 322.

Figure 18:
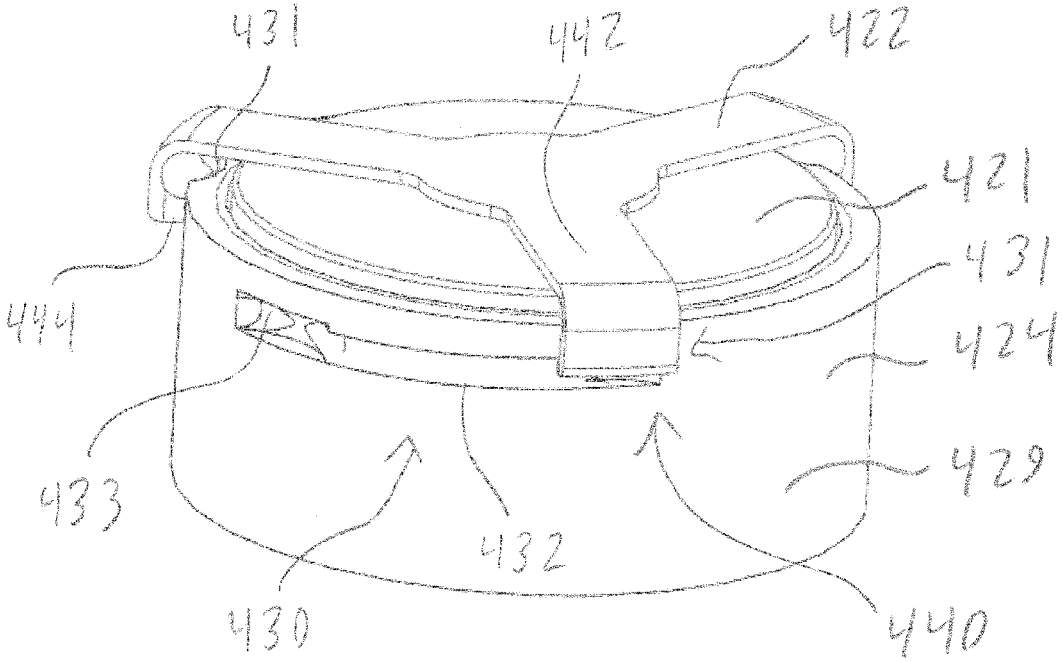
FIG. 18 illustrates a perspective view of additional embodiments of a weight member retained by a weight retainer in a weight mount.
Figure 19:
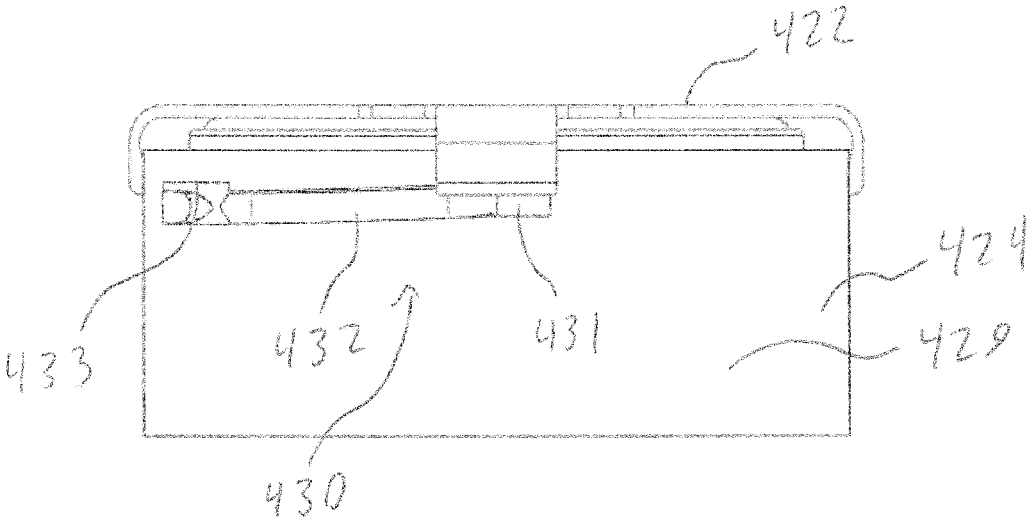
FIG. 19 illustrates a side view of the weight member, weight retainer, and weight mount illustrated in FIG. 18.

FIG. 18 illustrates a perspective view of additional embodiments of a weight member 421 retained by a weight retainer 422 in a weight mount 424. FIG. 19 illustrates a side view of the weight member 421, weight retainer 422, and weight mount 424 illustrated in FIG. 18. In this embodiment, the weight member 421 can be a separate component from the weight retainer 422 or they could be affixed to one another. The weight mount includes a locking feature 430 configured to lock the weight retainer 422 in place. As illustrated in FIGS. 18 and 19, the locking feature can be a slot 430 configured to receive a portion of the weight retainer 422. The slot 430 is formed into an outer wall 429 of the weight mount 424.

The weight retainer can include at least one engagement feature 440 configured to engage the locking feature 430 of the weight mount 424 and lock the weight retainer 422 to the weight mount 424. As illustrated in FIGS. 18 and 19, the engagement feature 440 can include a deflectable arm 442 and a protrusion 444. The deflectable arm 442 is configured to deflect so that the protrusion 444 can move in a direction substantially parallel to the axis of rotation of the weight retainer 422. The protrusion 444 is configured to engage the locking feature 430 of the weight mount.

The slot 430 can include an entry portion 431, a transition portion 432, and a detent 433. The slot 430 is configured to deflect the deflectable arm 442 of the weight retainer 424 as the weight retainer 422 is rotated relative to the weight mount 424. The entry portion 431 is configured to receive the engagement feature 440 of the weight retainer 422 as the weight retainer 422 is installed into the golf club head. The transition portion 432, is configured to deflect the deflectable arm 442 of the weight retainer 422 as the weight retainer 422 is rotated. The detent 433 is configured to receive the protrusion 444 of the engagement feature 440. As illustrated in FIGS. 18 and 19, the transition portion 432 is angled such that the distance of the slot 430 from the outer edge of the weight mount 424, in a direction parallel to the rotation axis of the weight retainer 422, increases along its length from the entry portion 431 to the detent 433. As the weight retainer 424 is rotated in a first direction, the deflectable arm 442 is loaded and deflected. Then the detent decreases the distance of the slot 430 from the outer edge of the weight mount 424. As the protrusion 444 enters the detent 433, the deflectable arm 442 forces the protrusion 444 into the detent 433, locking the weight retainer 424 and thusly the weight member 422 in place.

Figure 20:
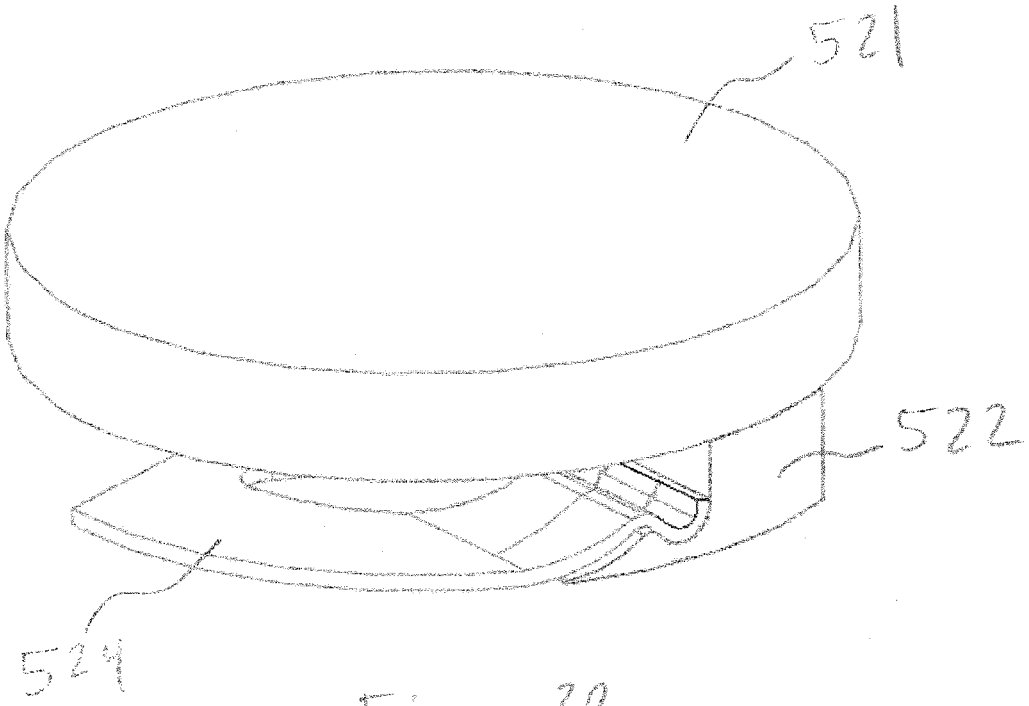
FIG. 20 illustrates a perspective view of additional embodiments of a weight member, weight retainer, and weight mount.
Figure 21:
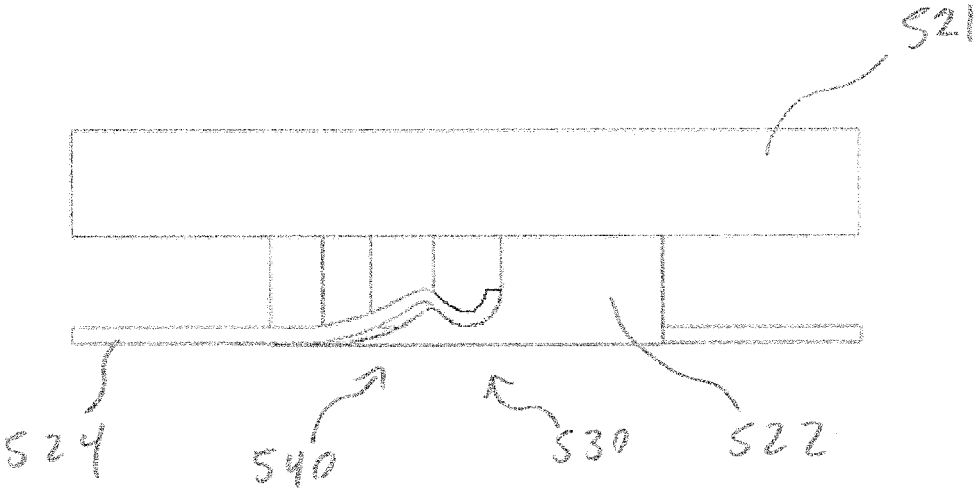
FIG. 21 illustrates a side view of the weight member, weight retainer, and weight mount of FIG. 20.
Figure 22:
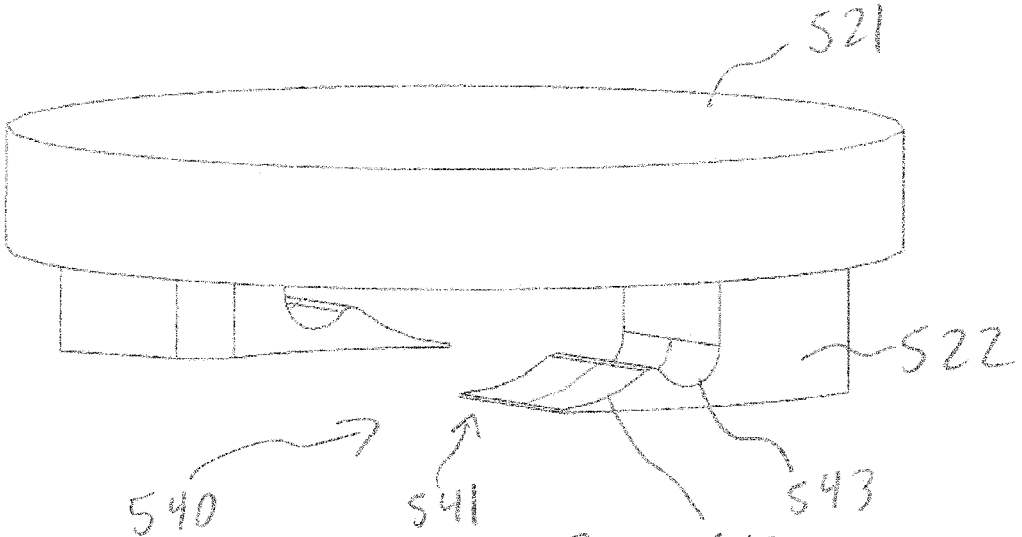
FIG. 22 illustrates a perspective view of the weight member and weight retainer of FIG. 20.
Figure 23:
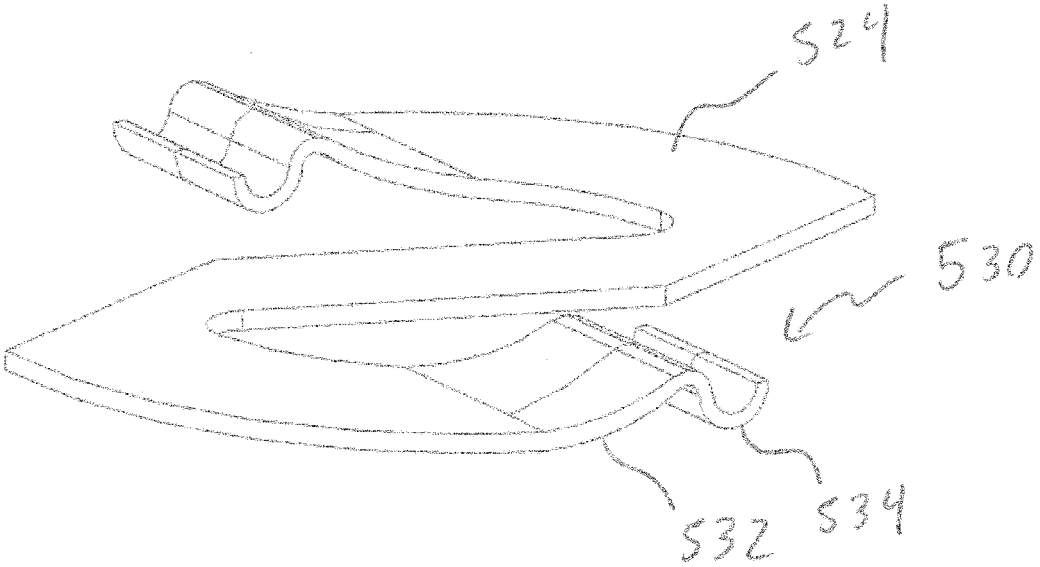
FIG. 23 illustrates a perspective view of the weight mount of FIG. 20.

FIG. 20 illustrates a perspective view of additional embodiments of a weight member 521, weight retainer 522, and weight mount 524. FIG. 21 illustrates a side view of the weight member 521, weight retainer 522, and weight mount 524 of FIG. 20. FIG. 22 illustrates a perspective view of the weight member 521 and weight retainer 522 of FIG. 20. FIG. 23 illustrates a perspective view of the weight mount 524 of FIG. 20. In this embodiment, rather than integrating a deflectable arm into the weight retainer as illustrated in other embodiments, the deflectable arm 532 is integrated into the weight mount 524. The weight retainer includes an engagement feature 540 configured to engage the locking feature 530 of the weight mount 524 and lock the weight retainer 522 to the weight mount 524. The engagement feature 540 can be a ramp 540 including an entry portion 541, a transition portion 542, and a detent 543. The weight mount 524 includes a locking feature 530 configured to engage the engagement feature 540 of the weight retainer 522. The locking feature 530 can include a deflectable arm 532 and a protrusion 534. As the weight member 521 and weight retainer 522 are rotated in a first direction, the locking feature enters the entry portion 541 of the ramp 540, and then the deflectable arm 532 begins to deflect as the protrusion 534 is forced away from the golf club head and towards the weight member 521 by the incline of the transition portion 542 of the ramp 540, until the protrusion 534 reaches the end of the transition portion 542 and is forced into the detent 543 by the spring force of the deflectable arm 532, as illustrated in FIGS. 20 and 21, locking the weight retainer 522 and weight member 521 in place.

Figure 24:
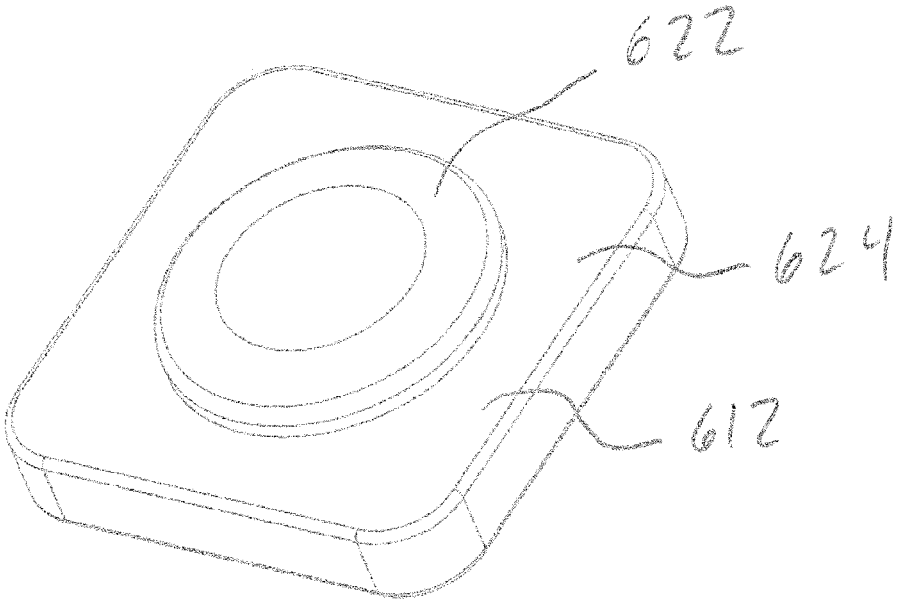
FIG. 24 illustrates an external perspective view of additional embodiments of a weight retainer locked in a weight mount.
Figure 25:
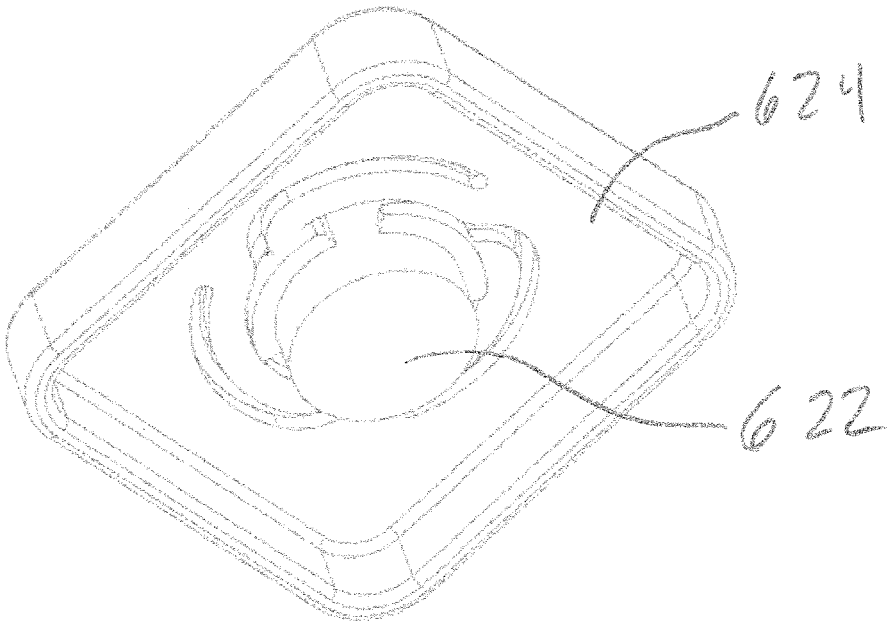
FIG. 25 illustrates an internal perspective view of the weight retainer and weight mount of FIG. 24.
Figure 26:
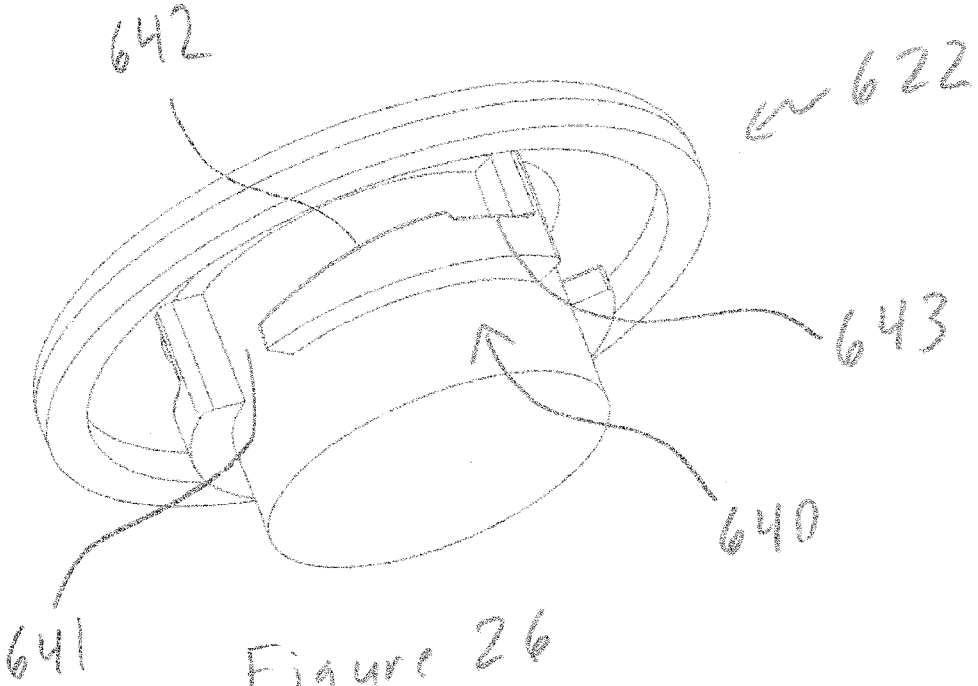
FIG. 26 illustrates a perspective view of the weight retainer of FIG. 24.
Figure 27:
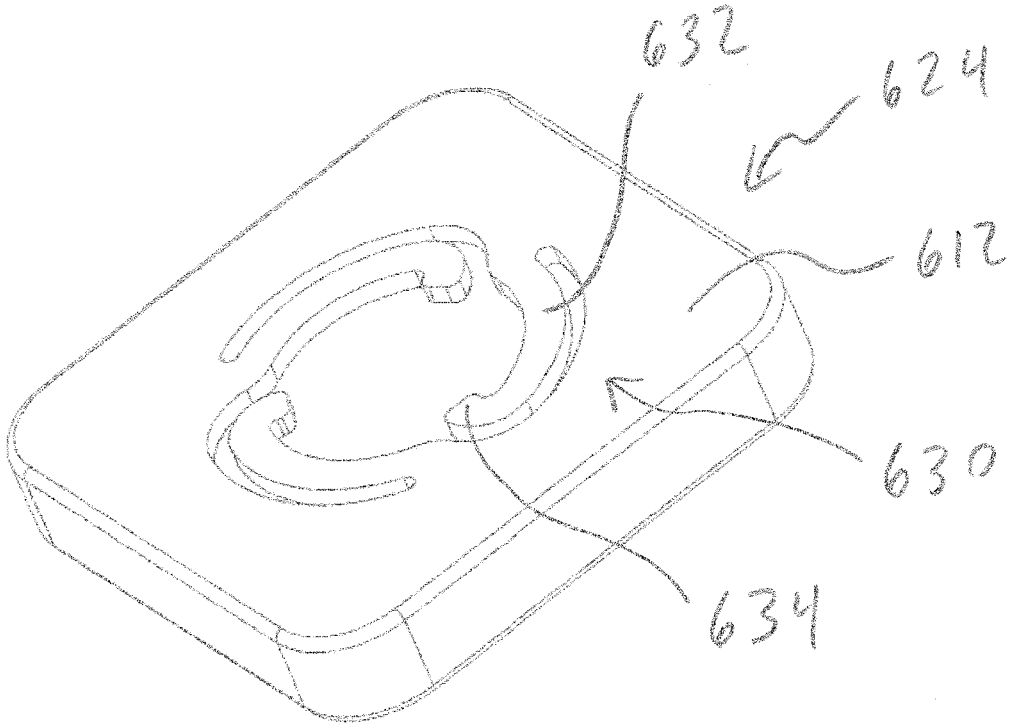
FIG. 27 illustrates an internal perspective view of the weight mount of FIG. 24.
Figure 28:
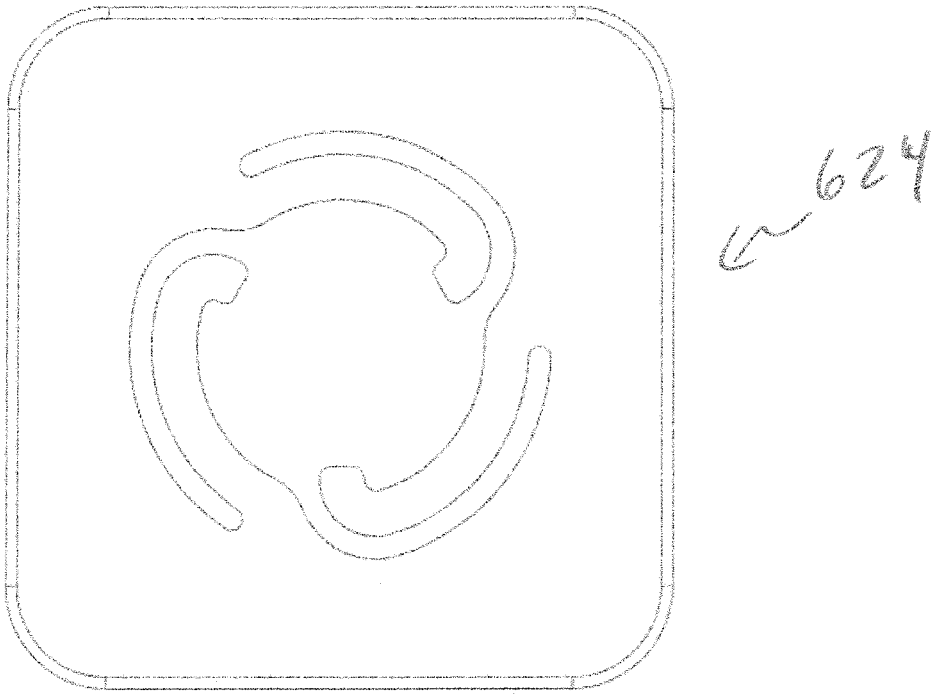
FIG. 28 illustrates an external top view of the weight mount of FIG. 24.
Figure 29:
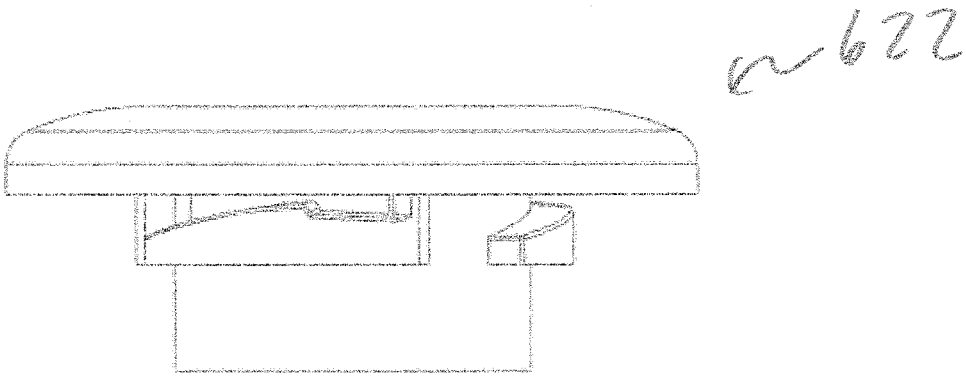
FIG. 29 illustrates a side view of the weight retainer of FIG. 24.
Figure 30:
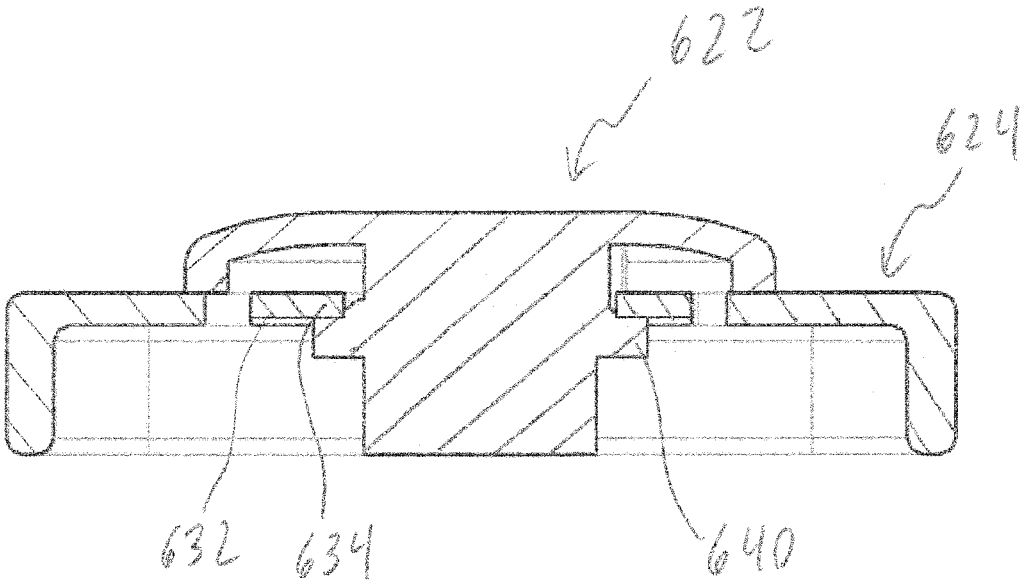
FIG. 30 illustrates a cross-sectional view of the weight retainer locked in the weight mount of FIG. 24.

FIG. 24 illustrates an external perspective view of additional embodiments of a weight retainer 622 locked in a weight mount 624. FIG. 25 illustrates an internal perspective view of the weight retainer 622 and weight mount 624 of FIG. 24. FIG. 26 illustrates a perspective view of the weight retainer 622 of FIG. 24. FIG. 27 illustrates an internal perspective view of the weight mount 624 of FIG. 24. FIG. 28 illustrates an external top view of the weight mount 624 of FIG. 24. FIG. 29 illustrates a side view of the weight retainer 622 of FIG. 24. FIG. 30 illustrates a cross-sectional view of the weight retainer 622 locked in the weight mount 624 of FIG. 24. The weight retainer 622 as illustrated herein, can integrally include a weight member.

The weight retainer 622 and weight mount 624 of FIGS. 24 through 30 share several similarities with the weight retainer 522 and weight mount 524 of FIGS. 20 through 23. The weight retainer 622 includes at least one engagement feature 640. The engagement feature 640 can be a ramp 640 as illustrated in FIG. 26. The ramp 640 can include an entry portion 641, a transition portion 642, and a detent 643.

The weight mount 624 includes at least one locking feature 630 configured to engage the engagement feature 640 of the weight retainer 622 and lock the weight retainer 622 to the weight mount 624. The locking feature 630 includes deflectable arm 632 and a protrusion 634. The protrusion 634 extends inward towards the axis of rotation of the weigh retainer 622 in a direction substantially perpendicular to the axis of rotation as opposed to the protrusion 532 of FIGS. 20-23, which extends towards the club head in a direction substantially parallel to the axis of rotation. Similar to the deflectable arm 532 of FIGS. 20-23, the deflectable arm 632 deflects allowing the protrusion 634 to move in a direction substantially parallel to the axis of rotation.

The entry portion 641 of the ramp 640 allows for the protrusion 634 to enter the transition portion 642 of the ramp 640. As the weight retainer 622 is rotated in a first direction, the protrusion 634 rides up the transition portion 642 of the ramp, deflecting the deflectable arm 632 until the protrusion reaches the end of the transition portion 642 and snaps into the detent 643, locking the weight retainer 624 in place. In some embodiments, the weight mount 624 includes an outer surface 612 configured to flushly integrate into an external surface of the golf club head, such as the sole 12, as illustrated in FIGS. 3 and 4. In some embodiments, and as illustrated in FIGS. 24-30, the locking feature 630 of the weigh mount 624 is all formed substantially planar, substantially minimizing manufacturing costs. Additionally, the weight mount 624, along with other weight mounts described herein, are shown separate from a golf club head for convenience, but are configured to integrate into the golf club head, preferably mounting substantially flush with an external surface of the golf club head, such as the sole.

In additional embodiments, not illustrated, the weight retainer 622 could include a slot similar to the one illustrated in FIG. 6, however it is formed in the weight retainer instead of the weight mount. The locking feature 630, as illustrated or substantially similar, could then deflect in a direction substantially perpendicular to the axis of rotation of the weight retainer, and the protrusion could pop into the detent, locking the weight retainer to the weight mount.

Figure 31:
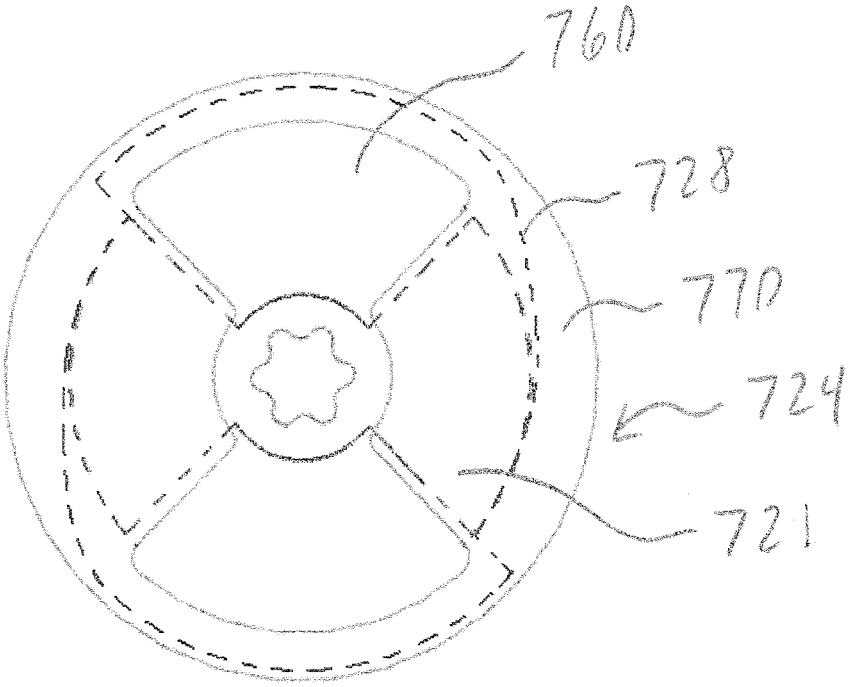
FIG. 31 illustrates a top view of an additional embodiment of a weight member locked in a weight mount.

FIG. 31 illustrates a top view of an additional embodiment of a weight member 721 locked in a weight mount 724. The weight mount 724 is similar to the weight mount of FIGS. 11 and 12, as it has an aperture 760 and an inner wall 728. However, the inner wall 728 of the weight mount 724 varies in distance from the axis of rotation of the weight member 721. The weight member 721 is inserted through the aperture into the weight mount 724, and then rotated in a first direction until the weight member 721 contacts the inner wall 728 of the weight mount 724, binding the weight member 721 and locking it in place. Additionally, the ceiling 770 can prevent the weight member 721 from dislodging from the weight mount 724.

Figure 32:
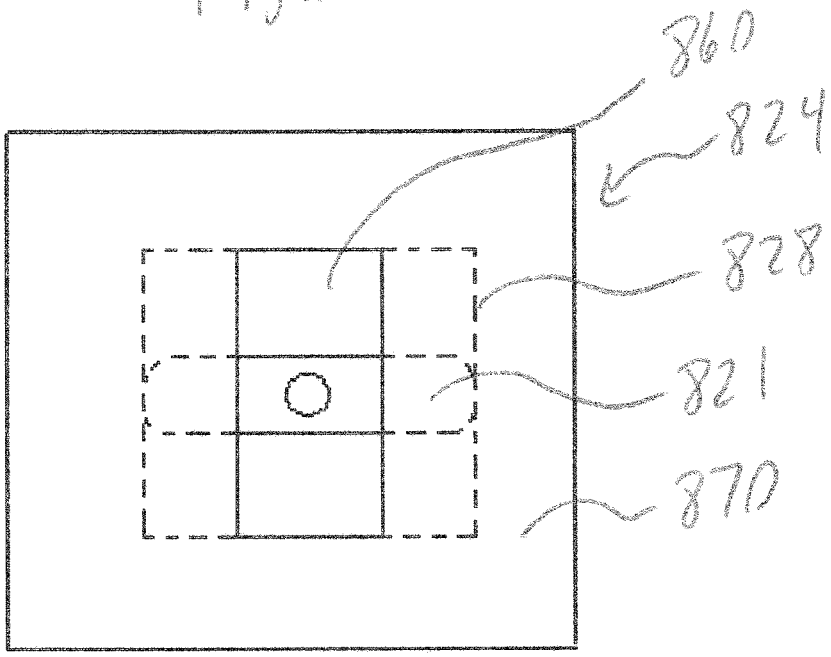
FIG. 32 illustrates a top view of an additional embodiment of a weight member locked in a weight mount.

FIG. 32 illustrates a top view of an additional embodiment of a weight member 821 locked in a weight mount 824. The weight mount 824 includes an aperture 860 configured to receive the weight member 821. The weight member is inserted through the aperture 860 and rotated in a first direction until it binds with the inner wall 828 of the weigh mount 824, locking the weight member 821 in place. Additionally, the ceiling 870 can prevent the weight member 821 from dislodging from the weight mount 824.

In describing the present technology herein, certain features that are described in the context of separate implementations also can be implemented in combination in a single implementation. Conversely, various features that are described in the context of a single implementation also can be implemented in multiple implementations separately or in any suitable sub combination. Moreover, although features may be described above as acting in certain combinations and even initially claimed as such, one or more features from a claimed combination can in some cases be excised from the combination, and the claimed combination may be directed to a sub combination or variation of a sub combination.

Various modifications to the implementations described in this disclosure may be readily apparent to those skilled in the art, and the generic principles defined herein may be applied to other implementations without departing from the spirit or scope of this disclosure. Thus, the claims are not intended to be limited to the implementations shown herein, but are to be accorded the widest scope consistent with this disclosure as well as the principle and novel features disclosed herein.

We claim:

1. A golf club head, comprising:
a hosel;
a striking face;
a sole extending aftward from a lower edge of said ball striking face;
a crown extending aftward from an upper edge of said ball striking face;
a skirt extending between said sole and said crown;
a plurality of weight mounts disposed on at least one of said sole, said crown, and said skirt; and
a weight retainer configured to engage said weight mounts;
wherein each of said plurality of weight mounts comprise a locking feature;
wherein said weight retainer comprises an engagement feature configured to engage the locking feature;
wherein said engagement feature and said locking feature are configured to releasably lock said weight retainer to said golf club head in less than one full rotation of said weight retainer relative to said golf club head around an axis of rotation;
wherein said engagement feature comprises a transition portion and a detent;
wherein said locking feature comprises a protrusion and a deflectable arm;
wherein said protrusion is configured to reside in said detent when said weight retainer is locked to said golf club head.

2. The golf club head of claim 1, wherein said engagement feature comprises a ramp.

3. The golf club head of claim 2, wherein said deflectable arm is configured to deflect as said protrusion rides up said transition portion of said engagement feature, and wherein said deflectable arm forces said protrusion into said detent.

4. The golf club head of claim 3, wherein said locking feature is configured to allow said protrusion to move in a direction substantially parallel to said axis of rotation as said deflectable arm deflects.

5. The golf club head of claim 1, wherein said weight mount is substantially flush with an external surface of said golf club head.

6. The golf club head of claim 1, wherein said weight mount, including said locking feature, is substantially uniform in thickness.

7. The golf club head of claim 1, wherein said weight retainer is permanently affixed to a weight member.

8. A golf club head, comprising:
a hosel;
a striking face;
a sole extending aftward from a lower edge of said ball striking face;
a crown extending aftward from an upper edge of said ball striking face;
a skirt extending between said sole and said crown;
a plurality of weight mounts disposed on at least one of said sole, said crown, and said skirt; and
a weight retainer configured to engage said weight mounts;
wherein each of said plurality of weight mounts comprise a locking feature;
wherein said weight retainer comprises an engagement feature configured to engage the locking feature;
wherein said engagement feature and said locking feature are configured to releasably lock said weight retainer to said golf club head in less than one full rotation of said weight retainer relative to said golf club head around an axis of rotation;
wherein said engagement feature comprises a protrusion;
wherein said locking feature comprises a transition portion and a detent;
wherein said protrusion is configured to reside in said detent when said weight retainer is locked to said golf club head;
wherein said engagement feature further comprises a deflectable arm, wherein said deflectable arm is configured to deflect as said protrusion slide along said transition portion of said locking feature, and wherein said deflectable arm forces said protrusion into said detent.

9. The golf club head of claim 8, wherein said engagement feature comprises a slot.

10. The golf club head of claim 9, wherein said slot is formed in an inner wall of said weight mount.

11. The golf club head of claim 8, wherein said engagement feature is configured to allow said protrusion to move in a direction substantially perpendicular to said axis of rotation as said deflectable arm deflects.

12. The golf club head of claim 8, further comprising a spring located between said weight mount and said weight retainer.

13. The golf club head of claim 8, wherein said weight retainer comprises a cavity configured to house a weight member.

14. A golf club head, comprising:
a hosel;
a striking face;
a sole extending aftward from a lower edge of said ball striking face;
a crown extending aftward from an upper edge of said ball striking face;
a skirt extending between said sole and said crown;
a plurality of weight mounts disposed on at least one of said sole, said crown, and said skirt; and
a weight retainer configured to engage said weight mounts;

wherein each of said plurality of weight mounts comprise a locking feature;

wherein said weight retainer comprises an engagement feature configured to engage the locking feature;

wherein said engagement feature and said locking feature are configured to releasably lock said weight retainer to said golf club head in less than one full rotation of said weight retainer relative to said golf club head around an axis of rotation;

wherein said engagement feature comprises a detent;

wherein said locking feature comprises a protrusion and a transition portion;

wherein said protrusion is configured to reside in said detent when said weight retainer is locked to said golf club head;

wherein said weight mount comprises a ceiling, wherein said ceiling is substantially flush with an external surface of said golf club head, and wherein said ceiling comprises an aperture configured to receive said weigh retainer in an unlocked position.

15. The golf club head of claim 14, wherein said wherein said ceiling further comprises an aperture configured to receive said weight retainer in an unlocked position.

16. The golf club head of claim 15, further comprising a spring, said spring configured to force said weight retainer towards said ceiling of said weight mount.

17. The golf club head of claim 16, wherein said spring is dome shaped.

18. The golf club head of claim 14, wherein said weight retainer is formed integrally with a weight member.

* * * * *